US009293802B2

(12) United States Patent
Voss et al.

(10) Patent No.: US 9,293,802 B2
(45) Date of Patent: Mar. 22, 2016

(54) ANTENNA TILE DEVICE AND COLD PLATE

(71) Applicant: ViaSat, Inc., Carlsbad, CA (US)

(72) Inventors: John Daniel Voss, Cumming, GA (US); Donald Lawson Runyon, Duluth, GA (US)

(73) Assignee: ViaSat, Inc., Carlsbad, CA (US)

( * ) Notice: Subject to any disclaimer, the term of this patent is extended or adjusted under 35 U.S.C. 154(b) by 261 days.

(21) Appl. No.: 14/163,919

(22) Filed: Jan. 24, 2014

(65) Prior Publication Data

US 2014/0139400 A1 May 22, 2014

Related U.S. Application Data

(63) Continuation of application No. 12/916,380, filed on Oct. 29, 2010, now Pat. No. 8,654,017.

(60) Provisional application No. 61/256,820, filed on Oct. 30, 2009, provisional application No. 61/265,596, filed on Dec. 1, 2009.

(51) Int. Cl.

| | |
|---|---|
| ***H01Q 1/02*** | (2006.01) |
| ***H01Q 1/28*** | (2006.01) |
| ***H01Q 21/06*** | (2006.01) |

(52) U.S. Cl.

CPC . *H01Q 1/02* (2013.01); *H01Q 1/28* (2013.01); *H01Q 21/065* (2013.01)

(58) Field of Classification Search

CPC ..... H01Q 1/02; H01Q 1/28; H01Q 21/065; H05K 7/20

See application file for complete search history.

(56) References Cited

U.S. PATENT DOCUMENTS

| | | | | |
|---|---|---|---|---|
| 5,459,474 | A | 10/1995 | Mattioli et al. | |
| 5,831,830 | A * | 11/1998 | Mahler | H01Q 1/02 165/185 |
| 5,940,031 | A | 8/1999 | Turlington et al. | |
| 6,323,809 | B1 | 11/2001 | Maloney et al. | |
| 6,463,301 | B1 | 10/2002 | Bevan et al. | |
| 6,624,787 | B2 | 9/2003 | Puzella et al. | |
| 7,139,258 | B2 | 11/2006 | Tillotson | |
| 7,348,932 | B1 | 3/2008 | Puzella et al. | |
| 7,671,696 | B1 | 3/2010 | Puzella et al. | |
| 7,859,835 | B2 * | 12/2010 | Puzella | H01Q 1/02 165/104.33 |
| 8,537,059 | B2 * | 9/2013 | Sauer | H01Q 1/02 343/705 |

(Continued)

OTHER PUBLICATIONS

Switched Fragmented Aperture Antennas, James C. Maloney, Morris P. Kesler, Lisa M. Lust, Lon N. Pringle, T. Lynn Fountain, Paul H. Harms, Signature Technology Laboratory, Georgia Tech Research Institute and Glenn S. Smith, School of Electrical and Computer Engineering Georgia Institute of Technology, 2000, IEEE, 4 pages.

(Continued)

*Primary Examiner* — Hoang V Nguyen

(74) *Attorney, Agent, or Firm* — Snell & Wilmer L.L.P.

(57) ABSTRACT

A method, system, and device relating to a broad-band fragmented aperture tile and antenna system are disclosed. In one exemplary embodiment, an aperture tile comprises a plurality of unit cells. The plurality of unit cells individually comprise a driven radiating element layer, a module layer having a printed circuit board, wherein the module layer comprises one or more of a time delay module, a radio frequency distribution module, a radio frequency module, or a digital signal processor. Furthermore the aperture tile is coupled to a cold plate configured for heat transfer.

17 Claims, 23 Drawing Sheets

(56) References Cited

U.S. PATENT DOCUMENTS

| | | | |
|---|---|---|---|
| 2009/0284415 | A1 | 11/2009 | Worl et al. |
| 2010/0157531 | A1 | 6/2010 | Mason et al. |

OTHER PUBLICATIONS

Small, Conformable, Multi-Band ESM Antennas for UAVS, Spectra Research, Inc., 2004, 6 pages.

Broad-Band Fragmented Aperture Phased Array Element Design Using Genetic Algorithms, Björn Thors, Hans Steyskal, Fellow, IEEE, and Henrik Holter, 3280 IEEE Transactions on Antennas and Propagation, vol. 53, No. 10, October 2005, 8 pages.

Multi-Purpose Antenna, Spectra Research, Inc., 2006, 4 pages.

100-to-1 Bandwidth New Planar Design Allows Fabrication of Ultra-Wideband, Phased-Array Antennas, John Toon, May 10, 2006, 2 pages.

100-to-1 Bandwidth New Planar Design Allows Fabrication of Ultra-Wideband, Phased-Array Antennas, John Toon, May 10, 2006, 3 pages.

Characteristics of a Broad-Band Wide-Scan Fragmented Aperture Phased Array Antenna Anders Ellgardt and Patrik Persson Div. of Electromagnetic Engineering, Royal Institute of Technology, Oct. 2006, 5 pages.

Fragmented Aperture Antenna Design of Miniaturized GPS CRPA: Model and Measurements, James G. Maloney, Bradford N. Baker, James J. Acree, John W. Schultz,John A. Little, Daniel D. Reuster, 2007, 4 pages.

USPTO; Office Action mailed May 20, 2013 in parent U.S. Appl. No. 12/916,380, 13 pages.

USPTO; Notice of Allowance mailed Oct. 7, 2013 in parent U.S. Appl. No. 12/916,380, 12 pages.

* cited by examiner

Scan directions used to evaluate the antenna elements.

737

C-130

ANTENNA TILE DEVICE AND COLD PLATE

CROSS REFERENCE TO RELATED APPLICATIONS

This application is a continuation of U.S. application Ser. No. 12/916,380, entitled "ANTENNA TILE DEVICE AND COLD PLATE," which was filed on Oct. 29, 2010. The '380 application is a non-provisional of U.S. Provisional Application No. 61/256,820, entitled "PASSIVE AIR COOLED ANTENNA SYSTEM," which was filed on Oct. 30, 2009. The '380 application is also a non-provisional of U.S. Provisional Application No. 61/265,596, entitled "ANTENNA TILE DEVICE AND DESIGN," which was filed on Dec. 1, 2009. All of the contents of the previously identified applications are hereby incorporated by reference for any purpose in their entirety.

FIELD OF INVENTION

The application relates to systems, devices, and methods for an antenna tile. More particularly, the application relates to a broad-band fragmented aperture printed circuit board antenna tile for use in a phased array antenna system. Furthermore, the application relates to systems, devices, and methods for cooling a phased array antenna system. More particularly, the application relates to passively cooling a mobile phased array antenna using moving air.

BACKGROUND OF THE INVENTION

A fragmented aperture antenna may include a patchwork of discrete conducting and substantially dielectric units distributed over a specified aperture. The conducting material may include any material that comprises a higher conductivity than the substantially dielectric unit materials. These units of dielectric and conducting materials may be referred to as bricks or tiles. In general, tiles may be units that comprise a portion of an antenna system.

A phased array antenna can be electrically steerable in elevation and azimuth, and may have electronic polarization control. It typically has few or no moving parts, and a low profile. These attributes make a phased array antenna ideal for mounting to a moving vehicle, such as an airplane. However, the phased array comprises several electrical circuits that consume a substantial amount of power during operation. This in turn results in a high level of elevated temperature and generation of heat. In general, the heat must be dissipated in order for the electrical circuits to operate efficiently and within the design parameters of the antenna.

The phased array aperture antenna systems comprising one or more antenna tiles typically utilize plug radiators to function as antennas. These plug radiators sit on top of, and are generally coupled to, integrated circuits. Additionally, due to space limitations, various elements are located off the integrated circuit chip. The plug radiators and extra couplings often times introduce losses, larger footprint, more hardware to malfunction, and greater cost. Furthermore, the historical phased array aperture antenna systems are not able to dynamically electronically control polarization and/or vector of the unit antenna tile. Additionally, cooling, if performed at all, is typically performed with space and power consuming fans with forced air or liquid cooling units. Thus, a need exists for an antenna tile system that overcomes these and other deficiencies.

SUMMARY OF THE INVENTION

In accordance with various aspects of the present invention, a method, system, and device relating to an antenna aperture tile is disclosed. In one exemplary embodiment, an aperture tile, which is part of a larger antenna system, comprises a radiating element, a printed circuit board, and various electronic modules. In an exemplary embodiment, the aperture tile implements a heat transfer system comprising a cold plate coupled to the printed circuit board and electronic modules. In another exemplary embodiment, the electronic modules of the aperture tile further comprises one or more of a time delay module, a radio frequency (RE) distribution module, a radio frequency module and/or a digital signal processor.

In accordance with various aspects of the present invention, a method and system for cooling a phased array antenna is presented. In an exemplary embodiment, a passive cooling system for a phased array antenna comprises a cold plate configured to have air flow through the plate. In an exemplary embodiment, the cold plate is operatively coupled to and located adjacent to element control electronics. In one embodiment, the element control electronics are connected directly to multiple radiating elements. In one embodiment, the radiating elements are located in one or more layers above the element control electronics. Furthermore, in various embodiments, other associated electrical components are located on or below the cold plate, on the opposite side of the element control electronics. In an exemplary embodiment, the cooling air flow is generated by the movement of the phased array antenna through the air, as the phased array antenna is mounted to a mobile platform.

In an exemplary embodiment, in order to dissipate heat, a cold plate has at least one opening to allow airflow through the phased array antenna. The cold plate has a front, back, top, bottom, and two sides. In an exemplary embodiment, the cold plate has a front opening and a back opening, and the air flows through the front opening and out the back opening. In another exemplary embodiment, the cold plate has multiple front openings and multiple back openings.

In another exemplary embodiment, a radome cover is held in contact with an antenna by a negative pressure created inside the radome. A vent connected to a lower pressure side of the radome cover or antenna results in downward pressure on the radome and pushes the radome into direct contact with the structure of the antenna. The radio frequency (RF) performance of the radome can be improved by reducing the material thickness and thus reduce RF insertion losses. In an exemplary embodiment, a reduction in the radome's structural stiffness is negated by the structural support provided by the antenna structure.

BRIEF DESCRIPTION OF THE DRAWING FIGURES

A more complete understanding of the present invention may be derived by referring to the detailed description and draft statements when considered in connection with the appendix materials and drawing figures, wherein like reference numbers refer to similar elements throughout the drawing figures, and:

DETAILED DESCRIPTION

While exemplary embodiments are described herein in sufficient detail to enable those skilled in the art to practice the invention, it should be understood that other embodiments may be realized and that logical electrical and mechanical changes may be made without departing from the spirit and scope of the invention. Thus, the following detailed description is presented for purposes of illustration only.

Figure 1:
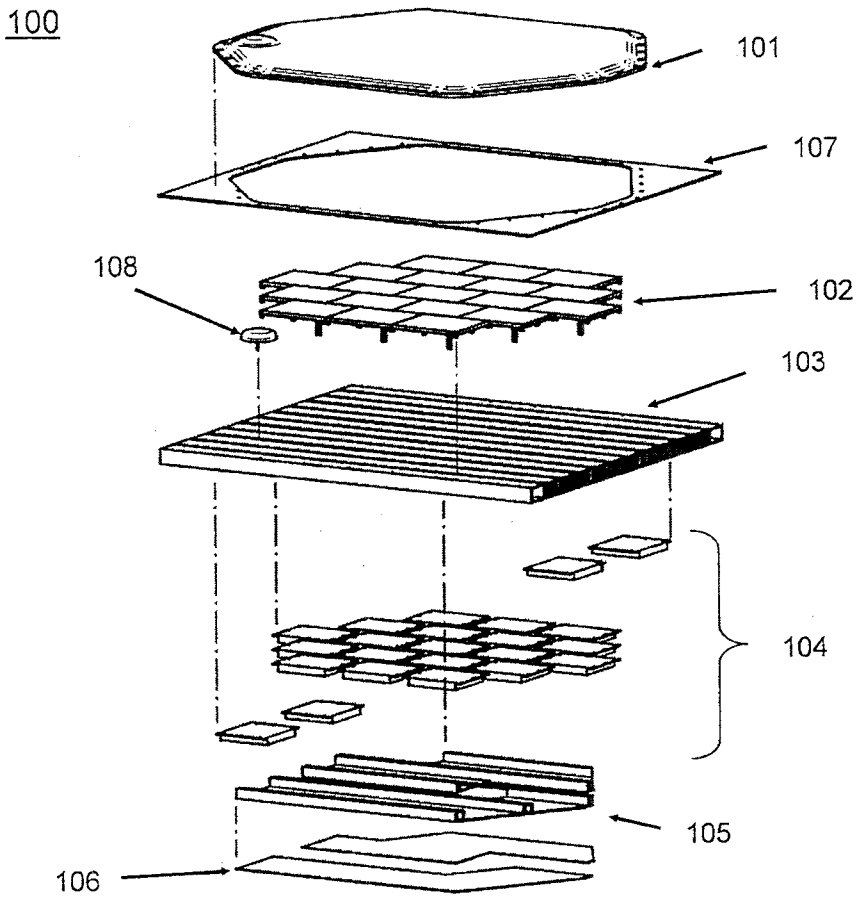
FIG. 1 illustrates an exploded view of a phased array antenna comprising a cold plate.

With reference to the detailed assembly shown in FIG. 1, in an exemplary embodiment, a phased array antenna 100 comprises a radome 101, multiple aperture tiles 102, a cold plate 103, and multiple electrical components 104. Furthermore, in an exemplary embodiment, the multiple electrical components 104 comprise at least one electronics power converter, at least one broadband up-down converter, at least one time delay and control unit, and multiple tile power converters. In another exemplary embodiment, phased array antenna 100 further comprises a printed circuit board (PCB) support structure 105, and a phase compensation PCB 106. Phased array antenna 100 may also include a radome adapter plate 107 and/or a GPS antenna 108.

Figure 2A:
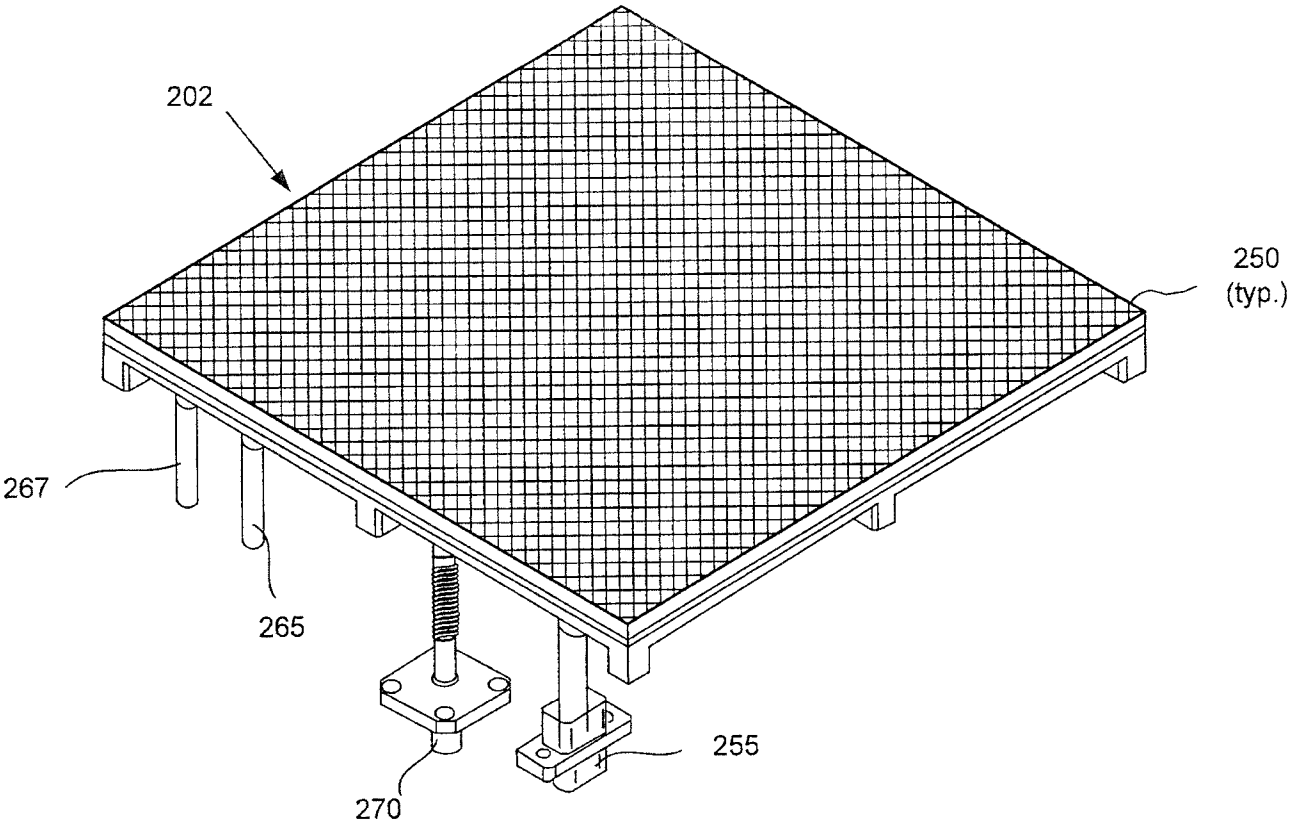
FIGS. 2A and 2B illustrate top and bottom views, respectively, of an exemplary antenna tile assembly according to various embodiments of the disclosure.
Figure 2B:
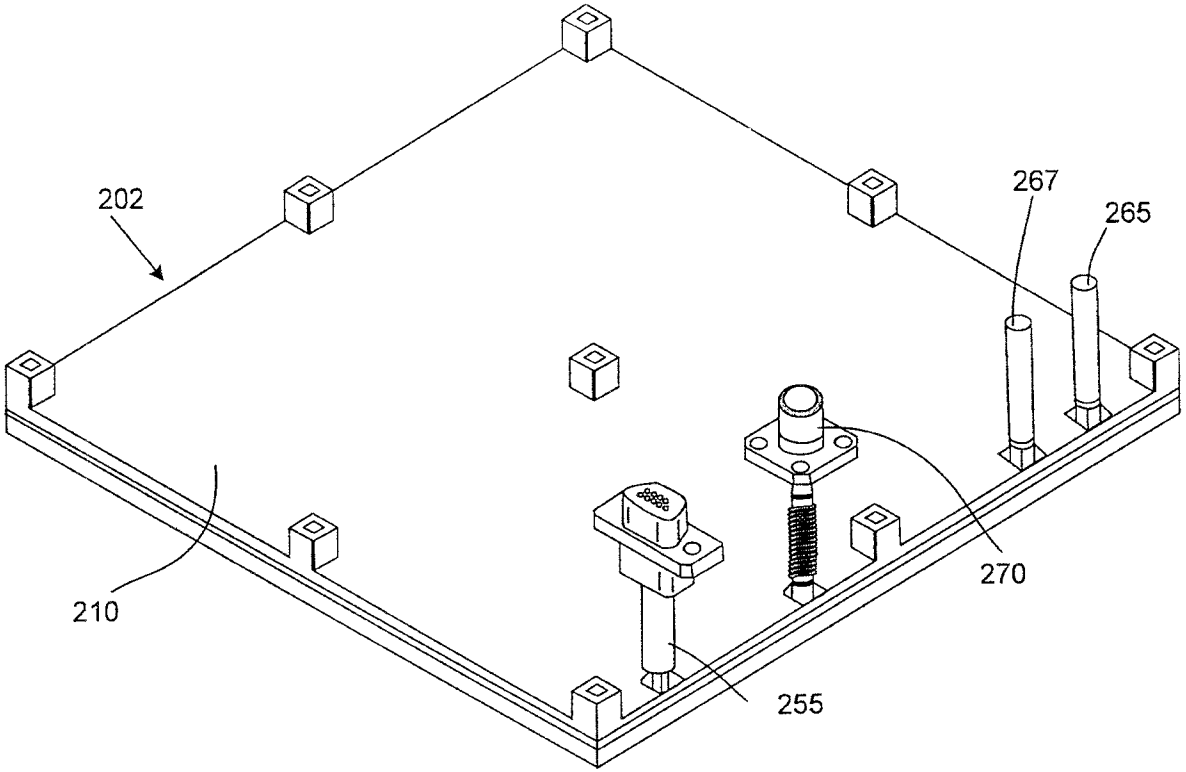

The multiple aperture tiles 102 comprises several aperture tiles in a plane arranged in various patterns, for example, a grid or offset, running bond pattern. In one exemplary embodiment and with reference to FIGS. 2A and 2B, a single aperture tile 202 connects to electrical components 104 via a DC power input connector 265, a DC power output (or return) connector 267, a data/control signal connector 255, and a radio frequency (RF) connector 270. Aperture tile 202 further comprises multiple unit cells 250 in an array lattice.

In an exemplary embodiment, aperture tile 202 comprises an optimizable periodic unit cell 250. The periodic unit cell 250 can be a symmetrical portion of a radiating element such as a one-half portion or a one-quarter portion. Alternatively, in an exemplary embodiment, periodic unit cell 250 may comprise a full radiating element or multiple radiating elements. In various embodiments, periodic unit cell 250 may have a boundary that is square, rectangular, hexagonal, or other suitable shape. In an exemplary embodiment, periodic unit cells 250 are arranged on a square grid with the periodic unit cell size 250 being approximately one-half wavelength size of the highest frequency of operation. An exemplary aperture tile 202 comprises 576 periodic unit cells arranged in 24 rows and 24 columns. An exemplary aperture tile with an operational band from 10.7 to 31 GHz has a square grid size of 0.196 inch (5 cm). Moreover, the aperture tile can be other suitable sizes and would be known to one skilled in the art.

In an exemplary embodiment, each periodic unit cell 250 of aperture tile 202 comprises four "feed vias." In another exemplary embodiment, each periodic unit cell 250 of aperture tile 202 comprises two "feed vias." The feed vias can be operated as differential pairs of feeds and each pair corresponds to a basis polarization of the radiating element. In one exemplary embodiment, a single pair of feed vias may be operated for a single basis polarization. Furthermore, in one exemplary embodiment, these feed vias are connected to balanced loads to terminate the signals entering the feed vias. In another exemplary embodiment, these feed vias are connected to at least one RF control module. In one exemplary embodiment, these feed vias are connected to the RF control modules through a beam stripline. In a second exemplary embodiment, these feed vias are connected to the RF control modules through a microstrip. In an exemplary embodiment, the microstrip is similar to the beam stripline in that both operatively contain RF transmission lines and may comprises RF power combiners and dividers.

In an exemplary embodiment, unit cell 250 comprises a single or dual polarized radiating element structure. In one exemplary embodiment, aperture tile 202 has a square lattice of radiating elements. In another exemplary embodiment, aperture tile 202 comprises a 24×24 lattice of dual polarized radiating elements, though any number of cell units may be arranged in any suitable configuration or shape. Furthermore, in another exemplary embodiment, the radiating elements operate over multiple frequency bands. For example, the radiating elements may be configured to operate over Ka-band and Ku-band frequencies. Similarly, in an exemplary embodiment, the radiating elements may operate over multiple polarizations. In one exemplary embodiment the phased array lattice of aperture tile 202 may be configured to communicate in half-duplex mode. In a second exemplary embodiment, aperture tile 202 may be for transmit only and in a third exemplary embodiment, aperture tile 202 may be for receive only. Moreover, antenna system configurations with separate aperture tiles for transmitting and for receiving may operate in full duplex mode.

Figure 3:
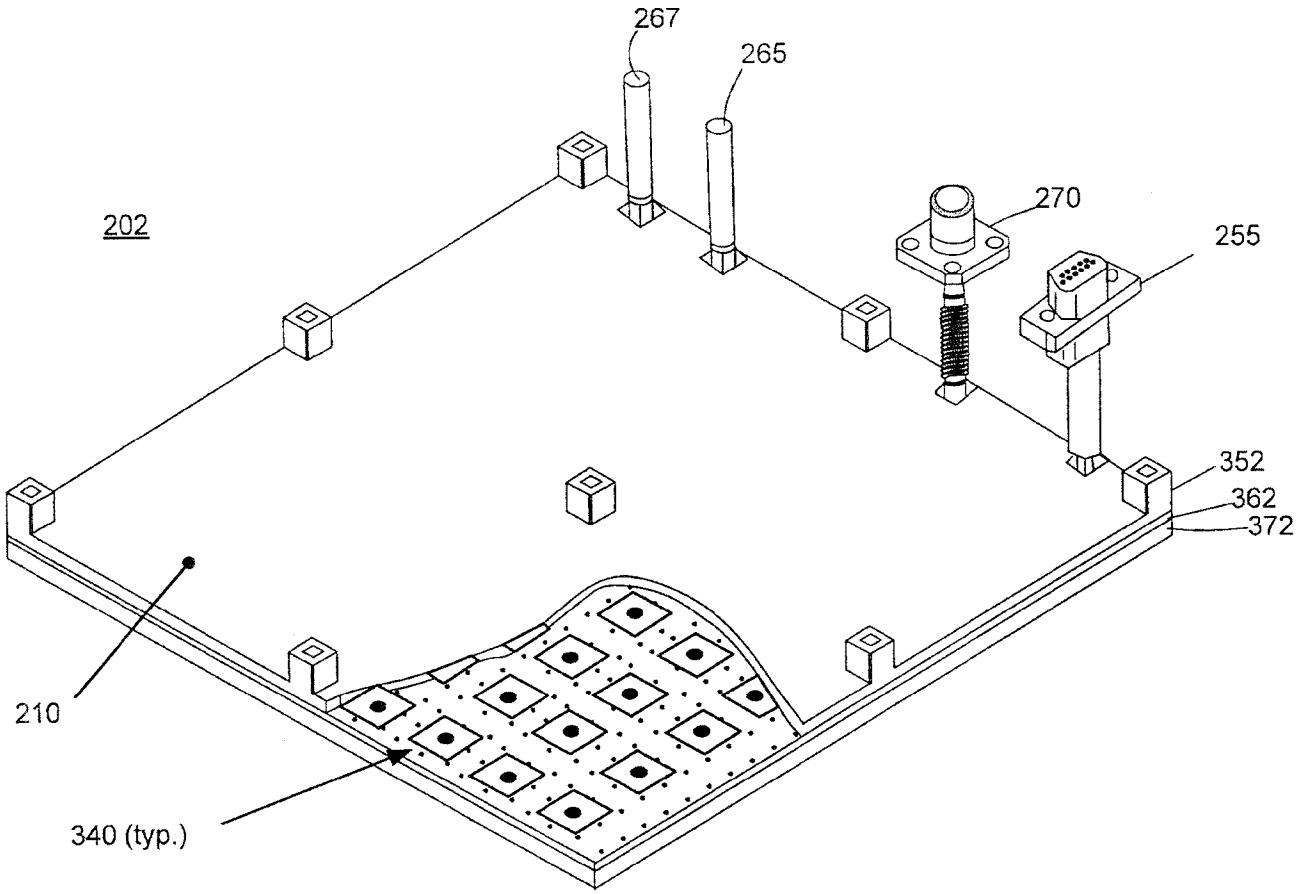
FIG. 3 illustrates a perspective view of an exemplary antenna tile assembly according to various embodiments of the disclosure.

In accordance with an exemplary embodiment and with reference to FIG. 3, aperture tile 202 comprises multiple layers, including an antenna laminate layer 372, a control/power laminate layer 362, and an RF circuit laminate layer 352. In an exemplary embodiment, aperture tile 202 further comprises a heat transfer layer 210, such as a cold plate. FIG. 3 also illustrates a cut-away view of an exemplary RF circuit laminate layer 352, which comprises an arrangement of RF control modules 340.

Figure 4A:
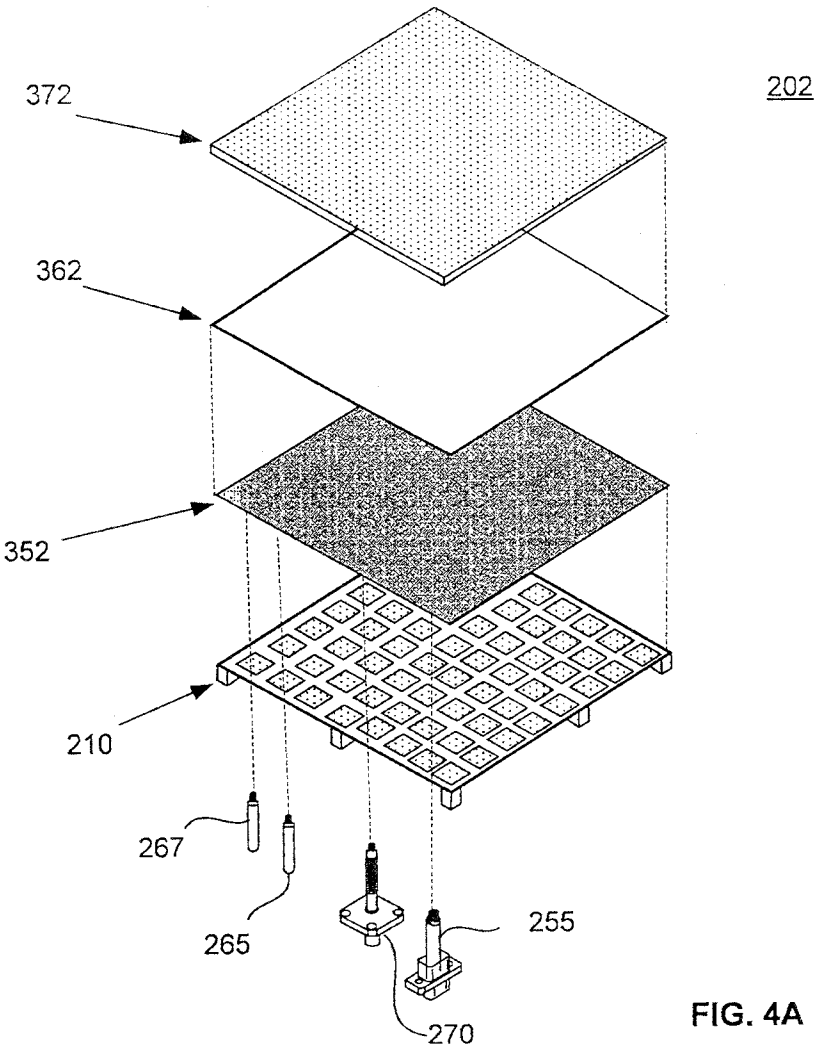
FIGS. 4A and 4B illustrate exploded views of an exemplary antenna tile assembly according to various embodiments of the disclosure.
Figure 4B:
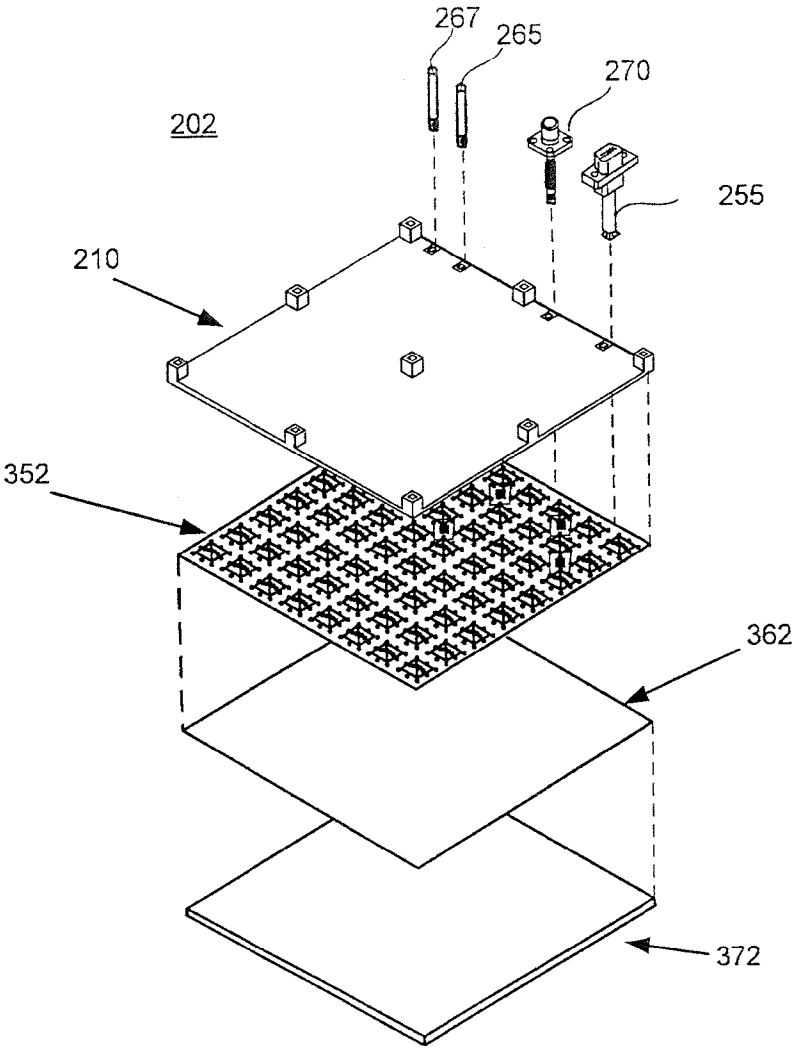

In an exemplary embodiment, and with reference to FIGS. 4A and 4B, an exploded view of aperture tile 202 is illustrated. As previously described, aperture tile 202 comprises an antenna laminate layer 372, a control/power laminate layer 362, an RF circuit laminate layer 352, and a heat transfer layer 210. Furthermore, FIGS. 4A and 4B illustrates the connection between RF circuit laminate layer 352 and various connectors, such as DC power input connector 265, DC power output connector 267, data/control signal connector 255, and radio frequency (RF) connector 270.

Figure 5A:
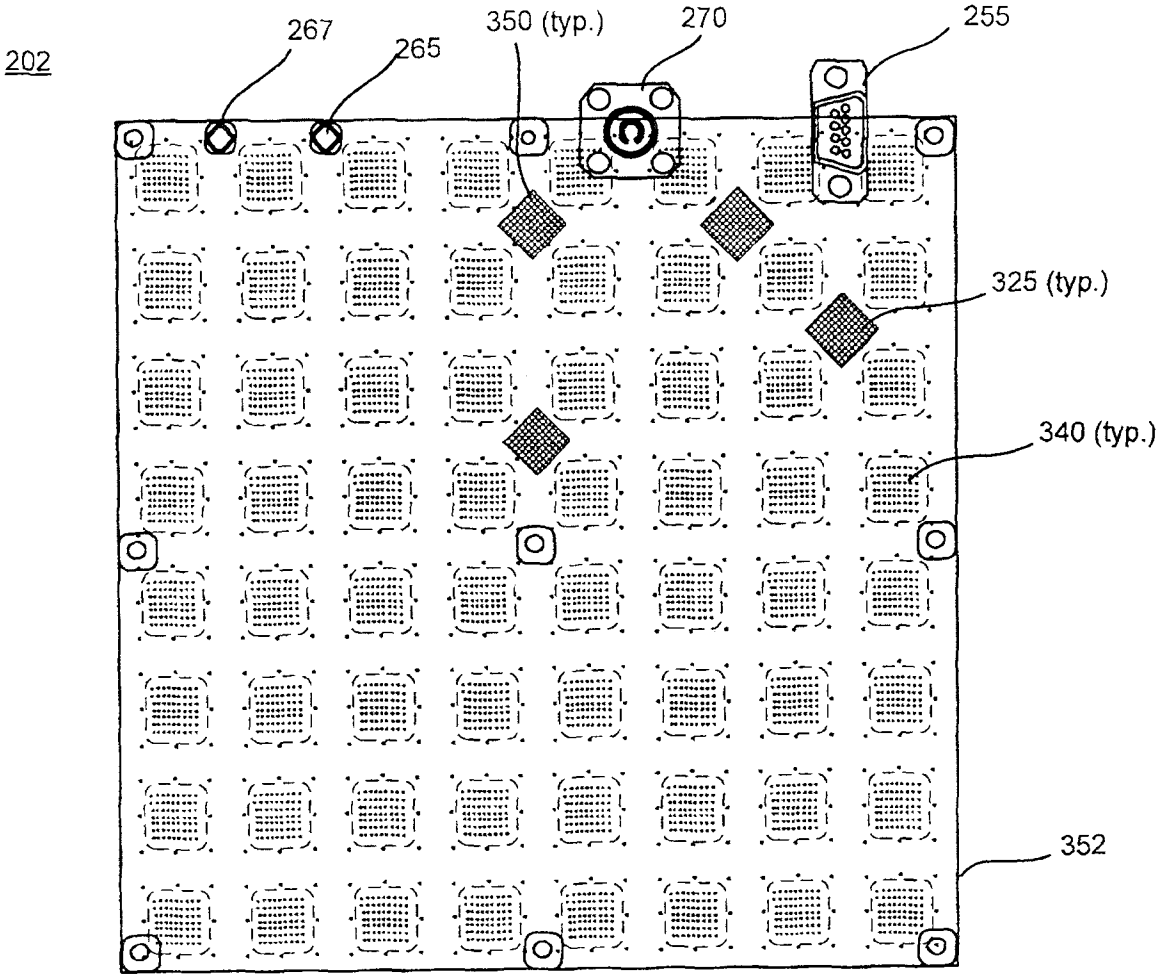
FIGS. 5A and 5B illustrate an aft view and a side view respectively, of an exemplary antenna tile assembly according to various embodiments of the disclosure.
Figure 5B:
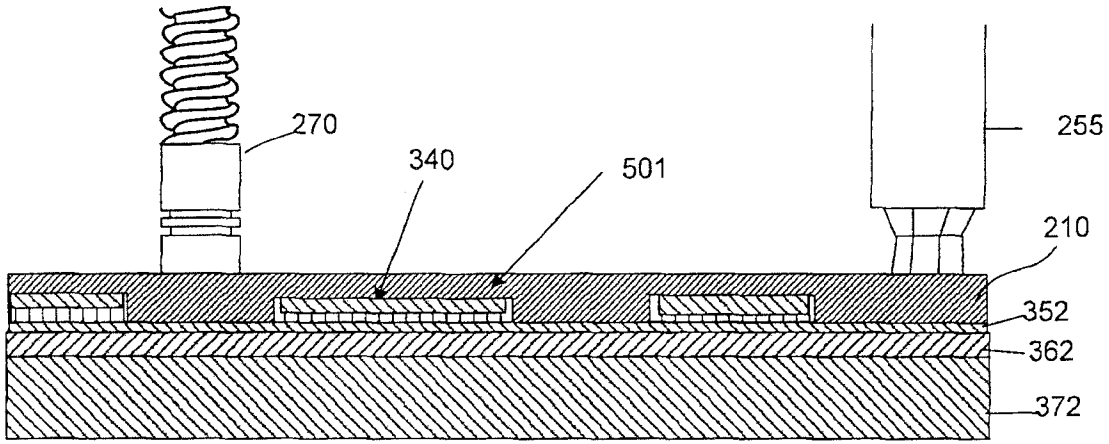

Furthermore, in accordance with an exemplary embodiment and with reference to FIGS. 5A and 5B, aperture tile 202, and specifically RF circuit laminate layer 352, comprises various active modules. In an exemplary embodiment, the active modules include RF control modules 340. In another exemplary embodiment, RF circuit laminate layer 352 comprises at least one time delay module 325, and/or at least one digital signal processor (DSP) 350. With reference to FIG. 5B, in an exemplary embodiment, heat transfer layer 210, such as a cold plate, to coupled to RF circuit laminate layer 352. In an exemplary embodiment, cold plate 210 may comprise openings to create a recess cavity 501. Recess cavity is configured to receive to a portion of phased array antenna 100, such as the active modules (for example, RF control modules 340). In one exemplary embodiment, these openings may be sized to mirror the size of the active modules without touching the active modules.

Figure 6:
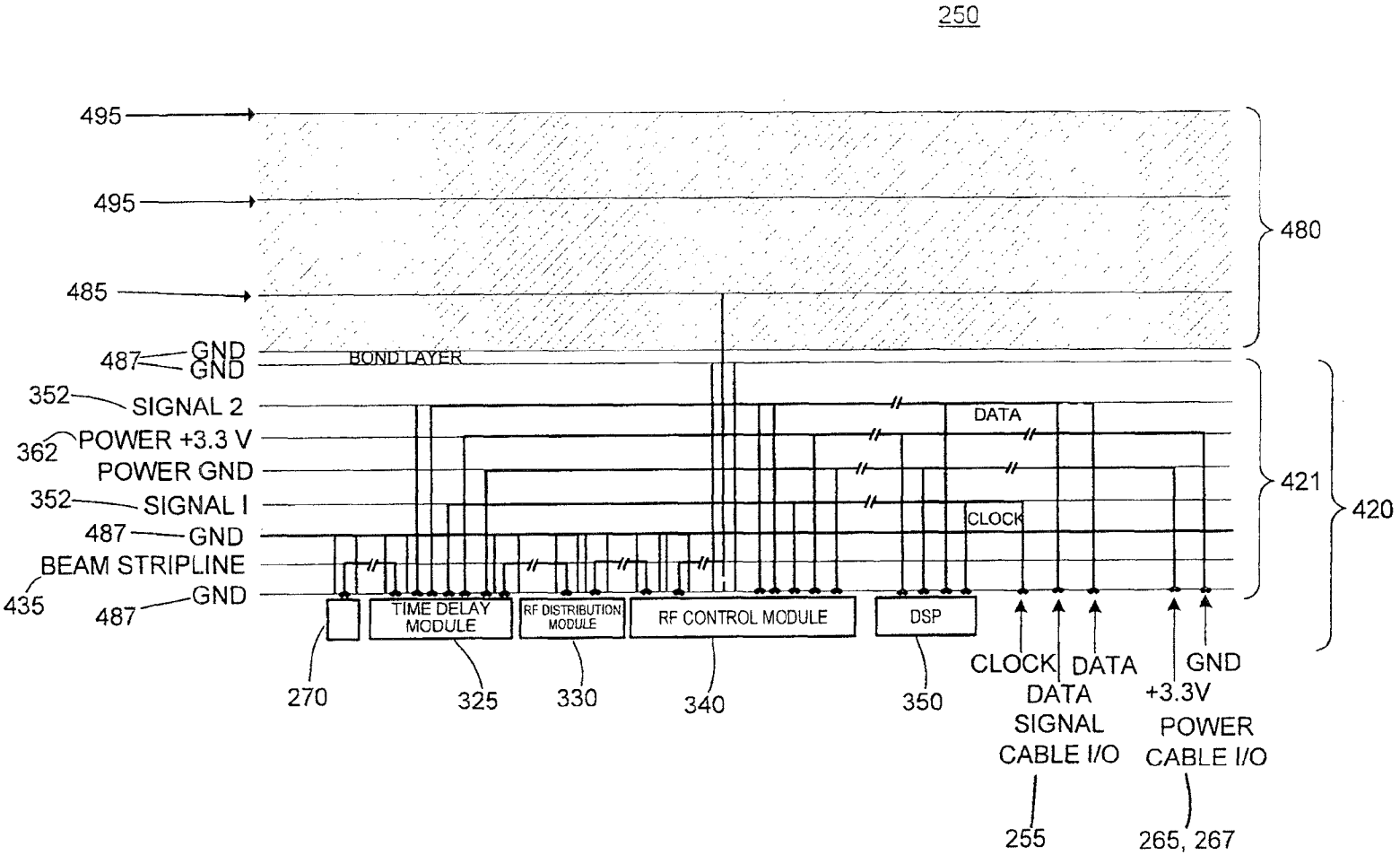
FIG. 6 illustrates an exemplary antenna tile printed circuit board layout according to various embodiments of the disclosure.

In one exemplary embodiment and with reference to FIG. 6, a unit cell 250 is a portion of aperture tile 202. In one exemplary embodiment, unit cell 250 comprises a driven radiating element layer 480 and a module layer 420, where module layer 420 includes a printed circuit board (PCB) layer 421. In an exemplary embodiment, module layer 420 provides amplification and signal distribution. Furthermore, in another exemplary embodiment, module layer 420 provides at least one of element control and RF signal vector control.

In an exemplary embodiment and with continued reference to FIG. 6, module layer 420 comprises a beam stripline 435, data/control signal connector 255, DC power input connector 265, DC power output connector 267, and radio frequency (RF) connector 270. In another exemplary embodiment, module layer 420 further comprises an RF distribution module 330, and RF control module 340. In yet another exemplary embodiment, module layer 420 further comprises digital signal processor (DSP) 350, and/or time delay module 325. DSP 350 and time delay module are implemented for larger scale antenna systems for added signal processing and control. In an exemplary embodiment, RF connector 270 comprises a coaxial connector. In accordance with an exemplary embodiment, module layer 420 and beam stripline 435 along with data/control signal connector 255, DC power input connector 265, DC power output connector 267, and RF connector 270 are housed in aperture tile 202. In the prior art, many of these elements were previously located off chip and coupled to the radiating element though a wired coupling. However, the wired couplings of the prior art may introduce one or more of losses, extra hardware, and costs.

As previously described, driven radiating element layer 480 is coupled to module layer 420, generally in a layered manner. In an exemplary embodiment, driven radiating element layer 480 comprises driven element 485 and a ground plane 487 to form a radiating element. In another exemplary embodiment, driven radiating element layer 480 further comprises a dielectric material, such as an aperture parasitic 495. In an exemplary embodiment, driven element 485 is operatively connected to RF control module 340, and RF control module 340 contains one or more electronic devices.

In one exemplary embodiment, module layer 420 is fabricated out Rogers Corporation RO4003 high frequency circuit material. In a second exemplary embodiment, module layer 420 is fabricated from a PTFE laminate such as Arlon DiClad-880 or Rogers Corporation 5880. In another exemplary embodiment, module layer 420 may be fabricated out of a material with a stable dielectric constant over a broad frequency range, such as the ceramic loaded PTFE based Rogers Corporation RO3003 or Arlon CLTE-XT. In another exemplary embodiment, FR4 may be utilized for various layers of module layer 420, such as RF circuit laminate layer 352 or control/power laminate layer 362. Furthermore, in other exemplary embodiments, module layer 420 is fabricated out of any suitable printed circuit board material, such as a glass reinforced hydrocarbon/ceramic thermoset laminate. In other exemplary embodiments, module layer 420 is fabricated out of a material with a low temperature coefficient of dielectric constant.

In one exemplary embodiment, module layer 420 comprises a beam stripline 435. The beam stripline 435 may be a transverse electromagnetic (TEM) transmission line medium. The width of the strip, the thickness of the substrate and the relative permittivity of the substrate determine the characteristic impedance of the strip, which is a transmission line. One or more of time delay module 325, RF distribution module 330, and RF control module 340 may be coupled to beam stripline 435. Furthermore, in an exemplary embodiment, beam stripline 435 is configured to perform one or more of routing, passive power dividing, and passive power combining the RF signals coupled to RF connector 270. A portion of the power dividing and/or power combining may be contained in RF control module 340 or a separate RF module.

In one exemplary embodiment, time delay module 325 is configured to provide a true time delay of the RF signal coupled to RF connector 270. Time delay may be utilized in addition to vector control in applications, resulting in wide bandwidths and wide scan angles for some aperture sizes. Furthermore, in an exemplary embodiment, time delay module 325 may be on the tile or associated with the electronics on the opposing side of the cold plate. For instance, time delay module 325 may conventionally comprise a switch delay line and/or plurality of RF transmission line segments with varied lengths. In accordance with an exemplary embodiment, time delay module 325 comprises a monolithic microwave integrated circuit (MMIC) to facilitate operation and result in a compact size. The MMIC may be made of silicon germanium, gallium arsenide, or other suitable material. In an exemplary embodiment, the total time delay injected by time delay module 325 is a function of the specific switch delay lines selected for utilization. The selection of the specific switch delay lines, in an exemplary embodiment, is based in part on an antenna aperture size and instantaneous bandwidth. In an exemplary embodiment, time delay module 325 has nine bits of control. In one exemplary embodiment, time delay module 325 is utilized on aperture tile 202 prior to an antenna system summing signals from two or more aperture tiles, using a next level RF power combining network. In another exemplary embodiment, time delay module 325 is utilized within a next level RF power combining network. Moreover, in an exemplary embodiment, time delay module 325 is electrically coupled to one or more RF control modules 340, RF distribution modules 330, DSP 350, data/control signal connector 255, DC power input connector 265, and/or DC power output connector 267.

Similarly, in an exemplary embodiment, RF distribution module 330 comprises a MMIC implemented power divider (or power combiner). The MMIC may be made of silicon germanium, gallium arsenide, or other suitable material. The power divider may be a passive power divider or may be an active power divider. Active power dividers may have zero net gain or may provide a positive RF signal gain. Furthermore, active power dividers may be more compact than passive power dividers but do consume electrical power. In an exemplary embodiment, RF distribution module 330 is electrically coupled to one or more time delay modules 325, and/or RF control modules 340. In an exemplary embodiment, beamforming for all of the radiating elements is accomplished on aperture tile 202 by at least the combination of RF control modules 340, RF distribution modules 330 and beam stripline 435. In accordance with an exemplary embodiment, RF distribution module 330 comprises a MMIC to facilitate operation and result in a compact size. Exemplary RF control modules 340 contain a plurality of vector generators that provide the phase and amplitude control at each radiating element and perform the polarization control. Furthermore, RF control modules 340 may perform beamforming for a subset of radiating elements. In one exemplary embodiment, RF control module 340 carries out the beamforming for eight radiating elements. In another embodiment, RF control module 340 carries out the beamforming for four radiating elements. Moreover, in an exemplary embodiment, RF control module 340 is configured to carry out the beamforming for any number of radiating elements, as would be understood by one skilled in the art. The remaining beamforming within aperture tile 202 may be shared by RF distribution module 330 and beam stripline 435. One optional approach is to carry out the remaining beamforming with RF distribution module 330 and rely on beam stripline 435 for RF signal routing. It is advantageous to carry out at least a portion of the remaining beamforming within RF distribution module 330 in order to reduce the size and complexity of beam stripline 435. However, in an exemplary embodiment, all remaining beamforming on aperture tile 202 can be completed within beam stripline 435.

Similar to time delay module 325 and RF distribution module 330, in an exemplary embodiment, RF control module 340 comprises a MMIC to facilitate operation and result in a compact size. The MMIC may be made of silicon germanium, gallium arsenide, or other suitable material. In accordance with an exemplary embodiment, RF control module 340 includes a vector control device. In one exemplary embodiment, the vector control device may control phase and amplitude of each element. In another exemplary embodiment, the vector control device may not comprise a separate phase shifter and attenuator but instead may comprise a single entity, such as a vector generator. The vector generator can be configured to control the phase and amplitude of signals.

In an exemplary embodiment, DSP 350 may provide local beam steering calculations and commands for each element. These steering calculations and commands may include I vector and Q vector calculations and commands. The steering calculations and commands may include both amplitude and phase calculations and commands for the vector control device. In an exemplary embodiment, DSP 350 provides a calculation and/or command to a vector generator for each basis polarization, phase and/or amplitude, for each element. The aggregate of the elements' polarization results in the total polarization of phased array antenna 100. In another exemplary embodiment, steering corrections may also be performed by a vector generator located off chip. These off chip corrections and commands may be communicated to the chip through a serial cable. The DSP 350 may be electrically coupled to one or more time delay modules 325, RF control modules 340, data/control signal connector 255, DC power input connector 265, and/or DC power output connector 267.

In accordance with an exemplary embodiment, RF control module 340 communicates bidirectional signals with the radiating element and includes a low noise amplifier (LNA) for receive signals and an RF power amplifier (PA) for transmit signals (not shown). In an exemplary embodiment, there is an LNA and a PA corresponding to each basis polarization of a radiating element. In an exemplary embodiment, RF control module 340 comprises the vector generators for each basis polarization. Vector generators may be separate for transmit and receive or they may be shared by transmit and receive operations. RF control module 340 may be electrically coupled to one or more of time delay module 325, RF distribution module 330, driven element 485, DSP 350, data/control signal connector 255, DC power input connector 265, and/or DC power output connector 267. Furthermore, RF control module 340 may send a signal to driven element 485.

In one exemplary embodiment, the radiating element of unit cell 250 may comprise any radiating element suitable to function as an antenna. For instance, the radiating element may be integrated on a printed circuit board (PCB) to form a PCB integrated radiating element. In another exemplary embodiment, the radiating element may comprise a dielectric plug radiator. A PCB integrated radiating element may be fabricated out of any suitable printed circuit board material. One example of a suitable material is Rogers corporation RO4003 high frequency circuit material. In another exemplary embodiment, the printed circuit board integrated radiating element may be fabricated out of a glass reinforced hydrocarbon/ceramic thermoset laminate. In one exemplary embodiment, the printed circuit board integrated radiating element may be fabricated out of a material with a low temperature coefficient of dielectric constant. In another exemplary embodiment, the printed circuit board integrated radiating element may be fabricated out of a material with a stable dielectric constant over a broad frequency range.

In one exemplary embodiment, unit cell 250 uses a fragmented aperture antenna and the radiating element is implemented in at least three conducting layers of a printed circuit board. The first conducting layer acts as a ground plane to the radiating element and the second conducting layer is the driven element and is direct connected to RF control module 340. A third conducting layer corresponds to a parasitic layer above the driven layer. In addition, there may be more than one parasitic layer in the radiating element design depending on the requirements for specific bands and scan performance.

The module layer 420 and driven radiating element layer 480 may be coupled together. In an exemplary embodiment, this coupling is made by any suitable means, such as by bond film, pre-preg and/or etching and bonding laminations. In one exemplary embodiment, module layer 420 and driven radiating element layer 480 constitute a single monolithic element. Additionally, in another exemplary embodiment, aperture tile 202 may be coupled to a control/telemetry unit or tile interface unit. Aperture tile 202 may also be coupled to a radome, such as an A-sandwich radome. Aperture tile 202 may be used with a B-sandwich or C-sandwich type radome or a radome comprising a plurality of layers. Furthermore, the radome may contain metal layers with circuit properties to provide frequency selective transmission properties. Moreover, in an exemplary embodiment, aperture tile 202 may further be coupled to a thermal management unit, such as a heat sink and/or a cold plate.

Various devices and methods have been used for cooling an array antenna system; such devices include use of a fan blower, which blows ambient air across the electrical components. Another typical device for dissipating heat from the antenna is a coil system that pumps cooled liquid throughout the antenna. The cooled liquid absorbs the heat from the antenna and is pumped to another coil section with lower temperature. Liquid systems use pumping in order to maintain the temperature control.

Figure 8B:
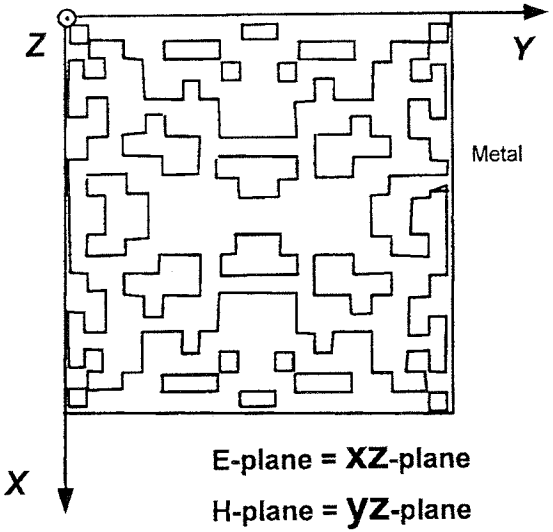
FIGS. 8A-8C illustrate an exemplary antenna tile unit, layout and degrees of freedom associated with an exemplary antenna tile unit.
Figure 8A:
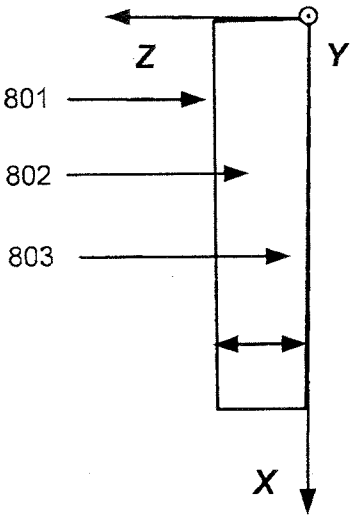
Figure 8C:
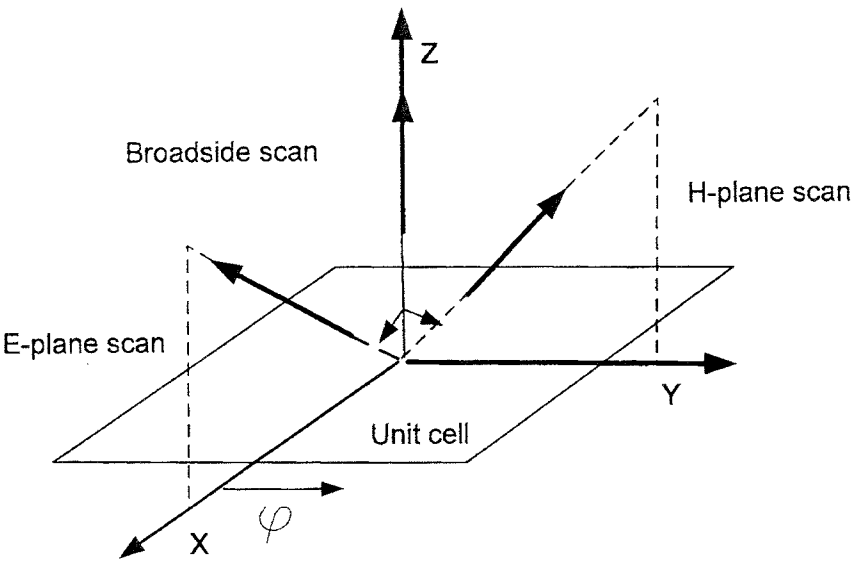

In another exemplary embodiment, aperture tile 202 may further comprise a fragmented surface, dielectric substrate, and/or a ground plane. With reference to FIGS. 8A-8C, exemplary embodiments of a fragmented surface 801, a dielectric substrate 802, and a ground plane 803 are now discussed. The thickness and relative permittivity of dielectric substrate 802 and the distribution of the conducting regions in the aperture surface are predetermined based on desired antenna system performance. Various frequency ranges in specified scan directions may be achieved according to the metallic patterns and details of the fragmented aperture surface in both a driven layer and optional parasitic layers. The metallic patterns may include grounding posts or vias to control the energy that may otherwise flow transversely in the dielectric structure. An antenna system impedance may vary with scan direction as a result of coupling between closely spaced radiating elements. This condition is conventionally known as the active impedance of the array. The scan directions may comprise the H-plane, E-plane, and broadside scan for linear polarization.

Generally, aperture tile 202 may be configured to provide electronic scan in any direction away from the boresight axis and may be configured to scan within a conical section or an asymmetrical section of space above aperture tile 202. In an exemplary embodiment, aperture tile 202 is configured to scan 70° from boresight at 30 GHz. In another exemplary embodiment, aperture tile 202 is configured to scan 40° or more from boresight at frequency in the range of 20 GHz to 60 GHz, specifically about 52 GHz. In another embodiment, the frequency range is 10.7 GHz to 31 GHz. In addition, throughout the scan volume, aperture tile 202 may have electronic polarization control.

Figure 7:
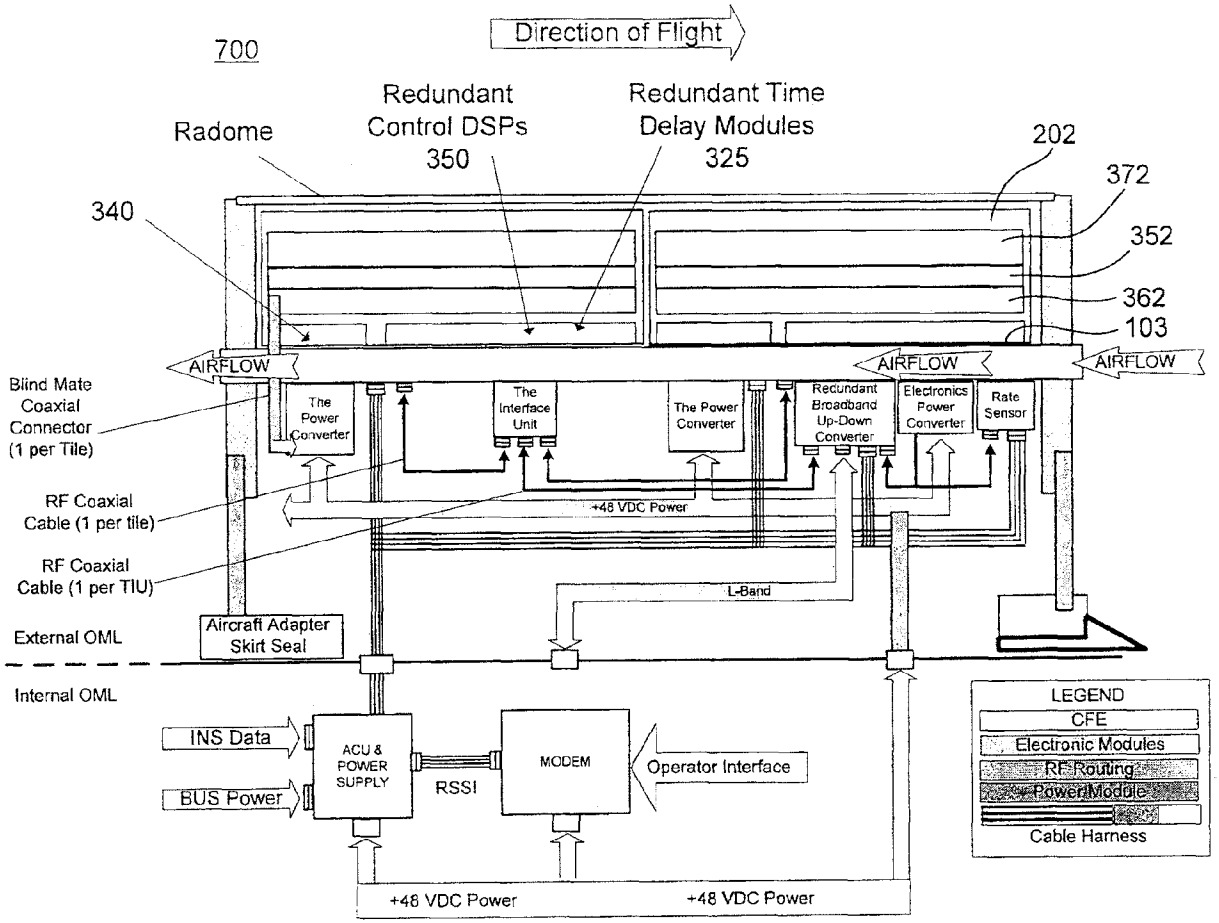
FIG. 7 illustrates a functional block diagram of an exemplary antenna tile according to various embodiments of the disclosure.

In addition to the electrical components and modules of an antenna tile, an antenna system also operatively uses other active components. In one exemplary embodiment and with reference to FIG. 7, an antenna system 700 may be coupled to one or more modems. Furthermore, in an exemplary embodiment, antenna system 700 includes a broadband up-down converter. The exemplary antenna system has a L-band intermediate frequency (IF) interface with the modem that can be 900 to 1500 MHz for Ka-Band RF operation or 950 to 2150 MHz for Ku-band operation. An alternate exemplary antenna system can be 950 to 2050 MHz for Ka-band operation. Moreover, the antenna system may have an IF interface frequency as designed, and thus not limited to the above frequency ranges. In addition, RF signals may be stacked in different IF bands. For example, a first band of frequencies may be in the 300 to 800 MHz band and a second band of frequencies may be in the 1650 to 2150 MHz band in a stacked arrangement. The use of an L-Band IF interface allows for the modem and antenna system to have a significantly greater installed separation distance between the units in contrast to units that are configured with a Ku-band or Ka-band interface. Furthermore, the use of an IF interface allows greater interoperability with modems across a deployed network and leads to lower overall system costs.

Each aperture tile 202 unit may be coupled to an adjacent aperture tile 202 by coaxial cables, flexible stripline, or other suitable transmission line means. In one exemplary embodiment, one or more aperture tiles 202 coupled together comprise a fragmented aperture. In an exemplary embodiment, a control unit controls operation of each radiating element. The radiating element operation is controlled, in one exemplary embodiment, by the control unit. In an exemplary embodiment, the control unit comprises a centrally located CPU with connections to each aperture tile via a serial bus. In another exemplary embodiment, the control unit is a combination of a centrally located processor and distributed processors or DSP in proximity with a group of aperture tiles 202. Alternatively, the distributed processors may be on each individual tile in the antenna system. Moreover, in an exemplary embodiment, the control unit configures the polarization of each aperture tile 202. The polarizations may be configured for linear polarization (horizontal or vertical) or circular polarization (left-hand or right-hand) of each aperture tile 202. The polarization may also be configured for elliptical polarization. In an exemplary embodiment, the polarization is configured for linear polarization or circular polarization with a high degree of linear or corresponding circular polarization purity. In other words, a linear or circular polarization characteristic with a defined maximum cross-polarization. In another exemplary embodiment, the control unit controls the pointing angle of each aperture tile 202. The pointing angle is the beam steering angle relative to the boresight direction of aperture tile 202.

The aperture tile 202 may comprise a portion of an antenna system configured to be mounted on a moving platform, such as on a vehicle. The vehicle may be a military vehicle such a boat, helicopter, plane or tank, and/or the vehicle may be a commercial vehicle such as a car, SUV, plane or truck. Likewise, in an exemplary embodiment, aperture tile 202 comprises a portion of an antenna system configured to be transported by a person, machine, and/or vehicle.

In an exemplary embodiment, a passive cooling system is advantageous because it comprises no active components such as may be included in liquid systems and fan blower systems. The active components consume power to operate, and can possibly fail and/or require maintenance. Another advantage of the passive cooling system is the reduced size in comparison to the liquid and fan cooling systems, which can be at a premium in an airplane or similar mode of transportation.

As briefly mentioned above and with renewed reference to FIGS. 1 and 6, phased array antenna 100 includes a method of heat transfer. In one exemplary embodiment, the antenna may comprise various heat dissipation approaches. To pass heat from aperture tile 102 and the various electrical components, a cold plate 103 may be coupled to module layer 420 side of phased array antenna 100. In an exemplary embodiment, cold plate 103 may comprise openings to receive a portion of phased array antenna 100, such as the active modules (such as RF control modules 340). In one exemplary embodiment, these openings may be sized to mirror the size of the active modules without touching the active modules. In another exemplary embodiment, the openings of the cold plate are in contact with various active modules. In one exemplary embodiment, cold plate 103 receives heat from a portion of phased array antenna 100 and communicates the heat to a heat sink. For instance, cold plate 103 may transfer the heat to the bottom surface of phased array antenna 100, where it may be transferred away from phased array antenna 100 by any suitable technique that does not interfere with the operation of the antenna system. These techniques may include forced air, coupling with moving air, coupling to another heat dissipation material, and/or liquid cooling.

Figure 9:
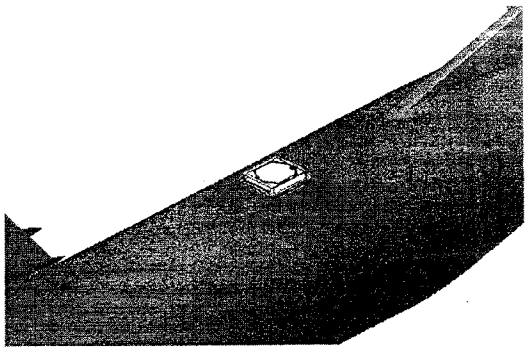
FIG. 9 illustrates various embodiments of an aircraft with a phased array antenna.
Figure 9:
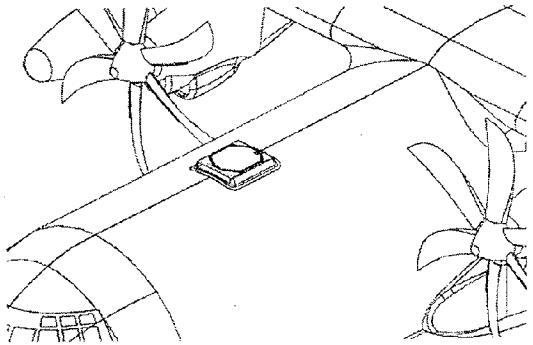
Figure 9:
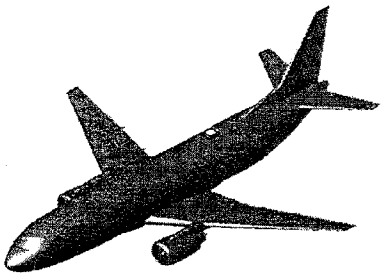
Figure 9:
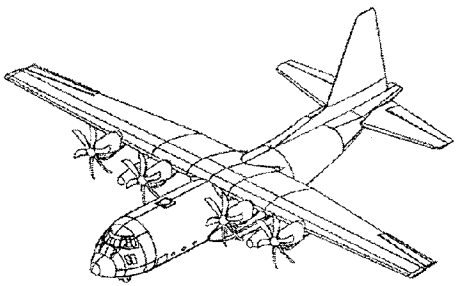

In accordance with an exemplary embodiment of the present invention, an antenna system, whether fragmented aperture or phased array, is located on a moving platform. In a preferred embodiment and with reference to FIG. 9, the phased array antenna is located on an airplane, which will be the example used throughout the description. More specifically, in an exemplary embodiment the phased array antenna is located on a commercial airplane or a military plane. In an exemplary embodiment, the phased array antenna is located on top of the plane's fuselage, and it may be near the cockpit or located closer to the tail section. In other various embodiments, the phased array antenna may be located on the side, bottom, or any other location on the airplane. However, it is also contemplated that the present invention may apply to phased array antennas located on helicopters, cars, boats, trains, or any other mode of moving transportation.

Figure 10A:
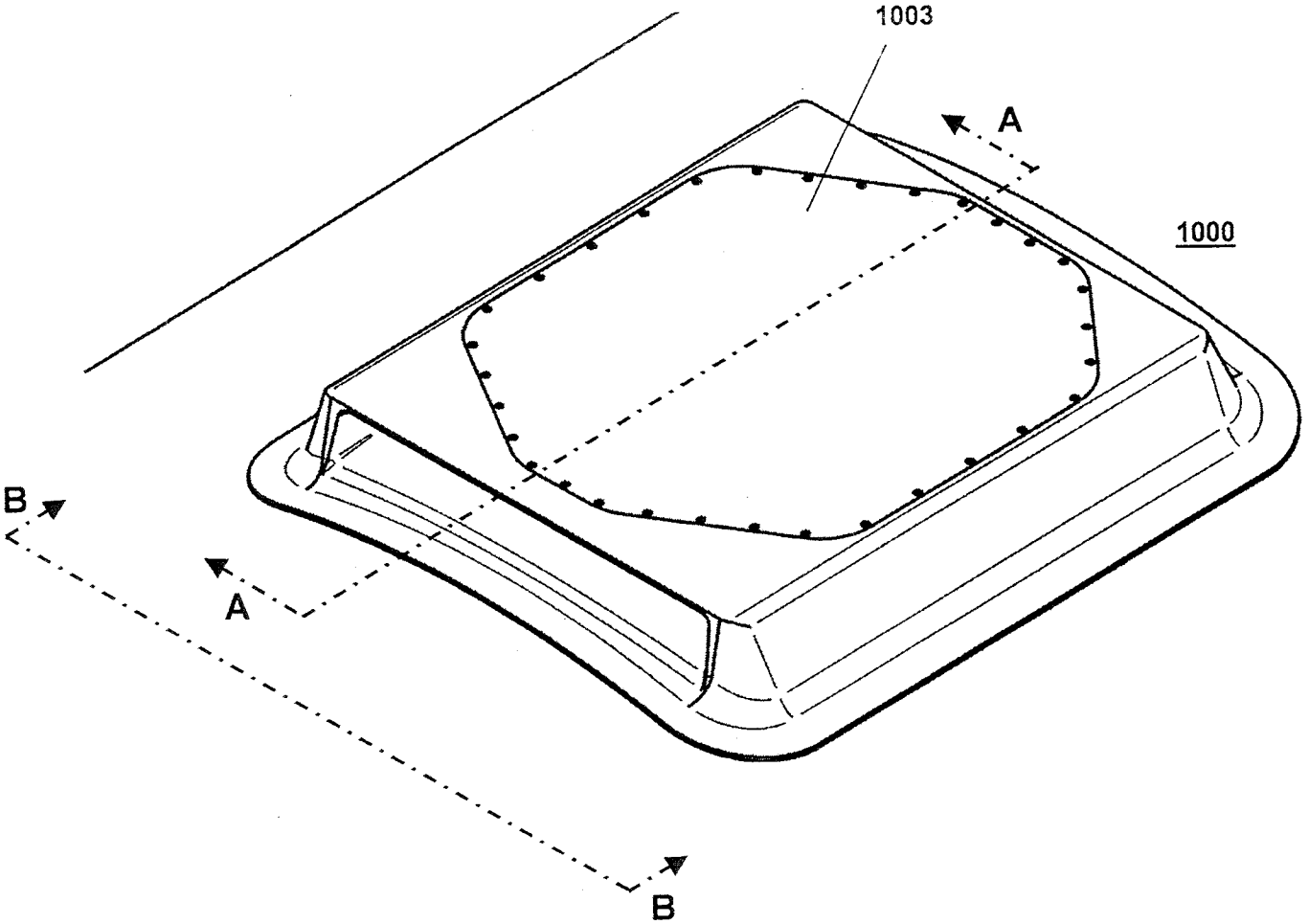
FIGS. 10A-10C illustrates perspective and sectional views of an exemplary embodiment of a passive air cooling system of a phased array antenna.
Figure 10B:
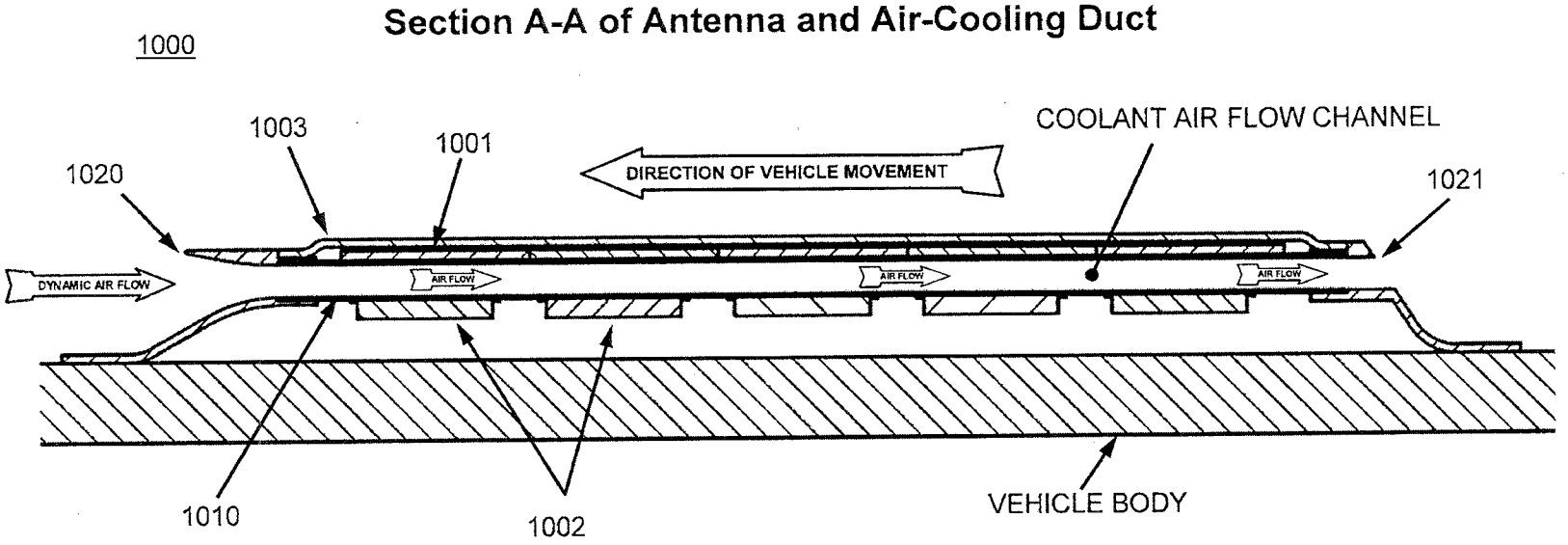
Figure 10C:
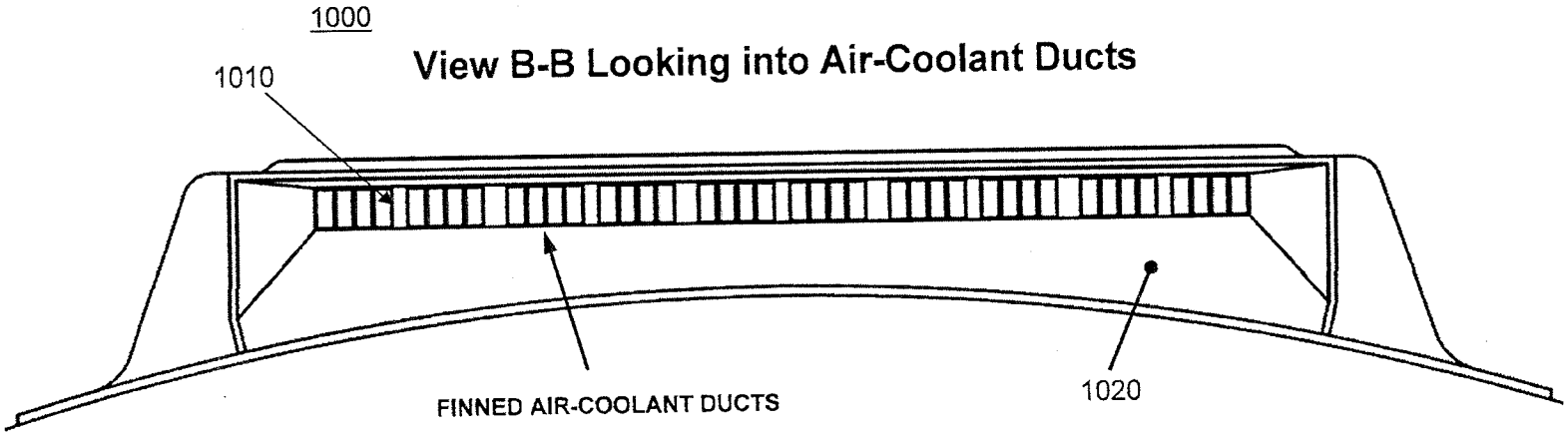

In an exemplary embodiment and with reference to FIGS. 10A and 10B, a phased array antenna 1000 comprises multiple radiating elements 1001 and electrical circuits 1002. Electrical circuits 1002 typically include phase shifters, control circuits, amplifiers, and the like. In an exemplary embodiment, electrical circuits 1002 are separate from the RF modules of the antenna tile and unit cell as previously described. Furthermore, phased array antenna 1000 may be housed under a radome 1003. In an exemplary embodiment, phased array antenna 1000 further comprises a cold plate 1010, as shown in FIG. 10C. In an exemplary embodiment, cold plate 1010 uses the movement of aircraft to cool phased array antenna 1000. In an exemplary embodiment, cold plate 1010 is a passive system with no moving parts. One advantageous aspect is the enablement of a longer useful life and fewer, or no, maintenance issues.

In an exemplary embodiment, a cold plate is configured to conduct heat away from the heat source(s). In one embodiment, the cold plate is located between the radiating elements and the electrical circuits. In another embodiment, the cold plate is located under the radiating elements and electrical circuits. In yet another exemplary embodiment, the cold plate is located under the radiating elements, yet has electrical circuits on both the top and bottom surface of the cold plate. Furthermore, the cold plate may be located on top of the fuselage. In another exemplary embodiment, a cold plate can provide structural support to other components. Since the cold plate is designed to be used on an airplane, a strong, lightweight material is preferable. For example, the cold plate may be made out of aluminum, copper, or steel. Moreover, the cold plate can be constructed out of any material that can provide structural support and/or conduct heat. Additionally, in an exemplary embodiment, the cold plate is formed using an extrusion process in order to form the desired cross-section.

Figure 11A:
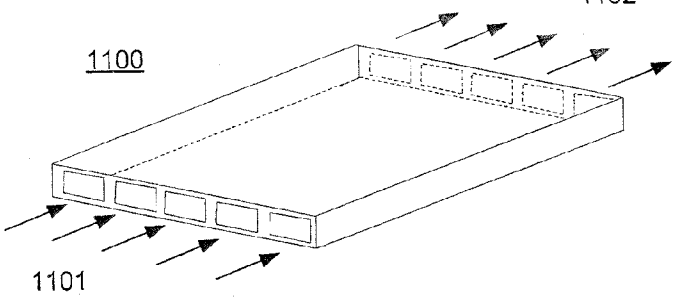
FIGS. 11A-11C illustrate exemplary embodiments of a cold plate for a passive air cooling system.

In an exemplary embodiment and with reference to FIG. 11A, a cold plate 1100 is typically designed in a rectangular shape. In another exemplary embodiment and as illustrated in FIG. 11C, cold plate 1100 is designed with a slightly curved shape to match the exterior curve of an airplane. Moreover, cold plate 1100 is not limited in shape and can also be elliptical, triangular, or a polygon.

In an exemplary embodiment and with continued reference to FIG. 11A, in order to dissipate heat, cold plate 1100 has at least one opening to allow airflow through the phased array antenna. The cold plate 1100 can be defined as having a front, back, top, bottom, and two sides. The front of cold plate 1100 is the direction in which the phase array antenna is traveling. In an exemplary embodiment, cold plate 1100 comprises a front opening 1101 and a back opening 1102, where the air flows through front opening 1101 and out back opening 1102. In another exemplary embodiment, cold plate 1100 comprises multiple front openings and multiple back openings.

Figure 11B:
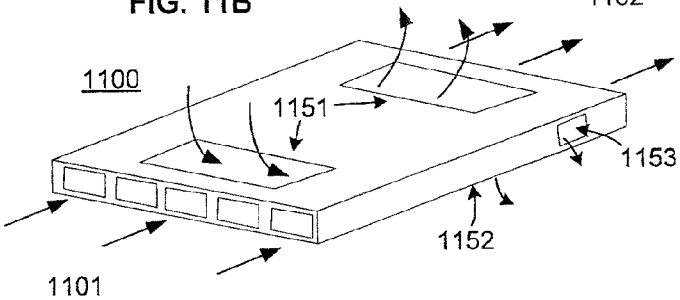
Figure 11C:
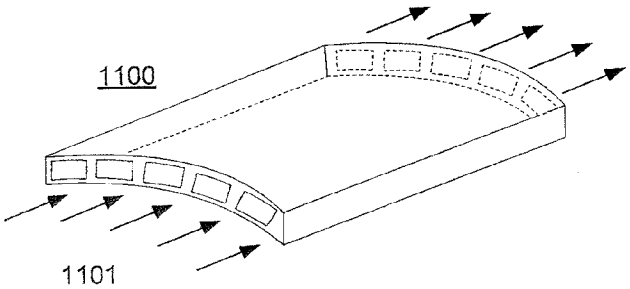

In yet another exemplary embodiment and with reference to FIG. 11B, cold plate 1100 further comprises at least one of a top opening 1151, a bottom opening 1152, or a side opening 1153. The different openings 1151, 1152, 1153 can be used for air intake or for air exhaust. For example, cold plate 1100 may be designed so that air flows into top opening 1151 and exits rear opening 1102 and side opening 1153. As one skilled in the art would understand, various placements of the openings and the corresponding input/output function of the openings are possible.

Figure 12:
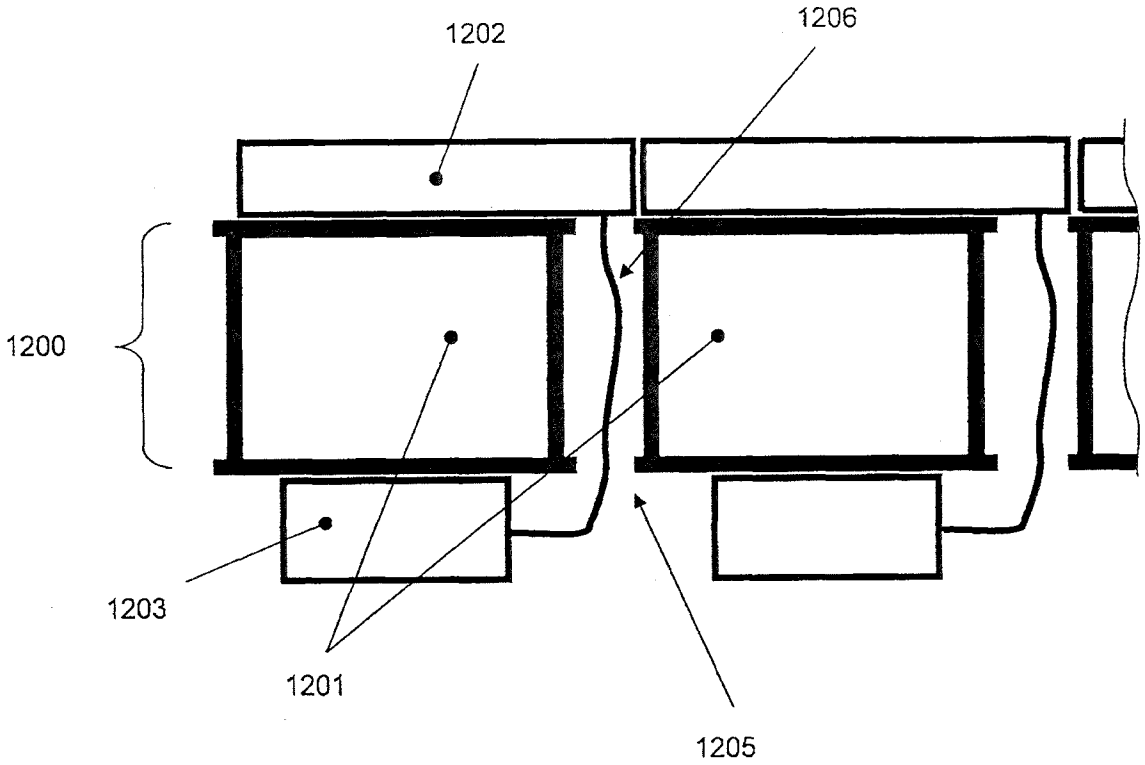
FIG. 12 illustrates another exemplary embodiment of a connection through a cold plate.

Furthermore, in accordance with an exemplary embodiment and with reference to FIG. 12, a cold plate 1200 also comprises interconnection ports 1205 for power connection and/or data connection. In an exemplary embodiment, interconnection ports 1205 allow a physical connection between an antenna tile 1202 above cooling plate 1200 and an electronic component 1203 below cooling plate 1200. FIG. 12 illustrates an exemplary sectional view of the front of cold plate 1200. In an exemplary embodiment, interconnection ports 1205 are configured to communicate analog signals, digital signals, and/or radio frequency signals. The connections may be interconnection cables 1206, such as coaxial cables. Interconnection cables 1206 may also be at least one of a blind mate coaxial, waveguide connection, twin lead wire, controlled impedance wire, and flex cable. In an exemplary embodiment, interconnection ports 1205 are formed by machining a hole through cold plate 1200, in an air channel 1201 or in an adjacent channel which can be blocked to air flow as shown in FIG. 12.

Figure 13:
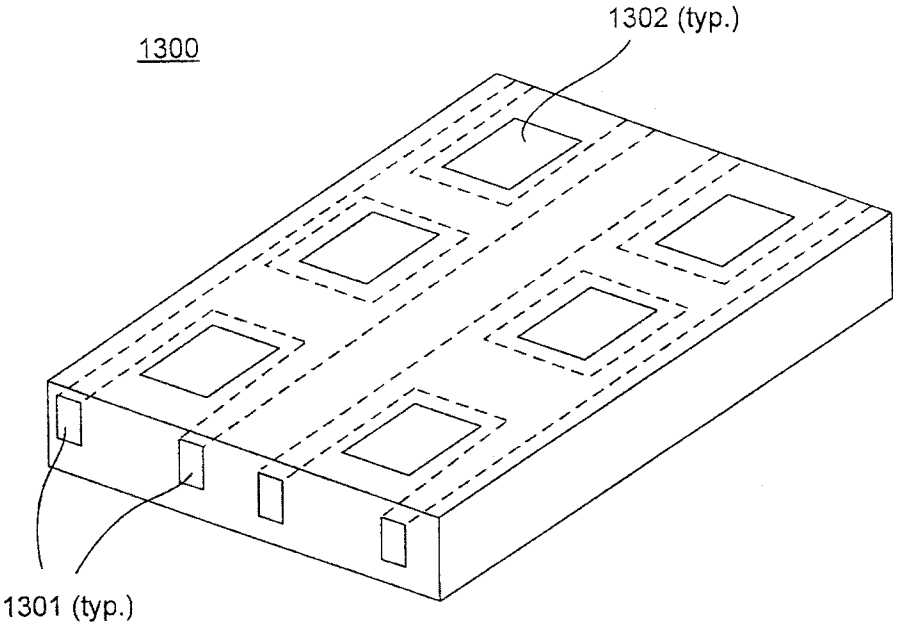
FIG. 13 illustrates another exemplary embodiment of a cold plate for a passive air cooling system.

Though the cold plate is generally described as providing airflow under the radiating elements and over electrical circuits, in an exemplary embodiment, the air flow is routed through and in between the electrical circuits (for example, the RF modules). In an exemplary embodiment and with reference to FIG. 13, this may be accomplished by having multiple air channels 1301 intermixed with electrical circuits 1302 on the same planar surface. In accordance with an exemplary embodiment, a cold plate 1300 is parallel to the direction of travel. In a more specific embodiment, the air path in air channel 1301 is substantially in a single direction from the intake portion of cold plate 1300 until the air exits through the rear output.

In one exemplary embodiment, the cold plate comprises air flow channels that are placed next to the hottest components only. The size of the cold plate is reduced by selectively designing the air flow channels to any hot spots. Thus, the overall size of the phased array antenna is also reduced. Moreover, in an exemplary embodiment, the cold plate is configured to dissipate heat in the range of 2-10 W/in2. In another exemplary embodiment, the cold plate is configured to dissipate heat in the range of 7-8 W/in2.

Additionally, in an exemplary embodiment, multiple phased array antennas could be present. This could be arranged by extending the cold plate to be located under the multiple phased array antennas. Another embodiment could comprise multiple cold plates corresponding to the multiple phased array antennas. Furthermore, other types of antennas may be present, such as a GPS antenna.

In an exemplary embodiment and with renewed reference to FIGS. 10B and 10C, cold plate 1010 is connected to an air intake portion 1020. Air intake portion 1020, in an exemplary embodiment, is a tapered scoop. The tapered scoop is a large opening that narrows into the cold plate. In another exemplary embodiment, air intake portion 1020 is the open edge of cold plate 1010. Air intake portion 1020 further comprises an air outlet 1021. In an exemplary embodiment, a first tapered scoop is at the front opening of cold plate 1010. In another embodiment, a second tapered scoop is located at the rear opening of cold plate 1010. The tapered scoop is configured to increase the air intake into cold plate 1010 by creating a pressure difference between the front and back of cold plate 1010. This in turn increases the velocity of the air flow through cold plate 1010. The ambient pressure surrounding the antenna has a significant influence on the cooling capabilities. For example, a plane flying at high altitude may have lower cooling capability in comparison to flying at a lower altitude due to the decrease of ambient pressure at high altitudes. Moreover, any device configured to increase the velocity and/or pressure at the inlet may be used in addition to, or in combination with, the tapered scoop.

The air intake portion 1020, in an exemplary embodiment, is elevated above the fuselage. Moreover, in the exemplary embodiment, the upper edge of any air intake portion 1020 remains within the boundary layer of the dynamic air flow. This is to minimize the aerodynamic drag effects caused by the protrusion of the phased array antenna from the fuselage.

Figure 14A:
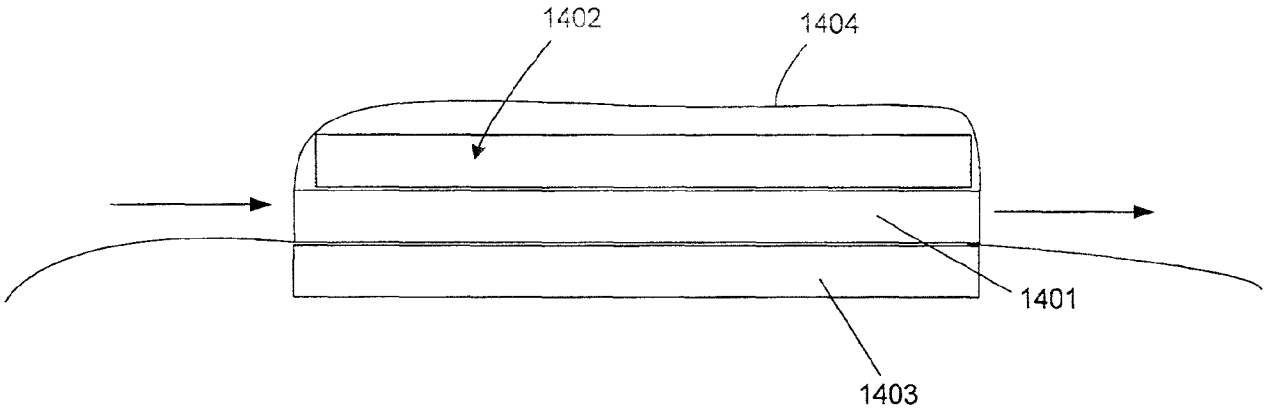
FIGS. 14A-14B illustrate exemplary embodiments of a phased array antenna and passive cooling system in relation to a mounting surface.

In another exemplary embodiment and with reference to FIG. 14A, a cold plate 1401 is substantially flush with the fuselage of the aircraft. Substantially flush means, for example, within 0-3 inches above or below the fuselage. In this design, radiating elements 1402 are on top of cold plate 1401 and raised away from the fuselage. The radiating elements 1402 may be under a radome 1404. Furthermore, cold plate 1401 is located over electrical circuits 1403, such as a power converter. In another embodiment, cold plate 1401 is only partially recessed, and neither cold plate 1401 nor radiating elements 1402 are flush with the fuselage. Since cold plate 1401 in this embodiment is at least partially above the fuselage, air is able to enter the front opening. However, in an exemplary embodiment, an air intake portion may be used in any embodiment in order to increase the dynamic pressure and velocity of air flow.

Figure 14B:
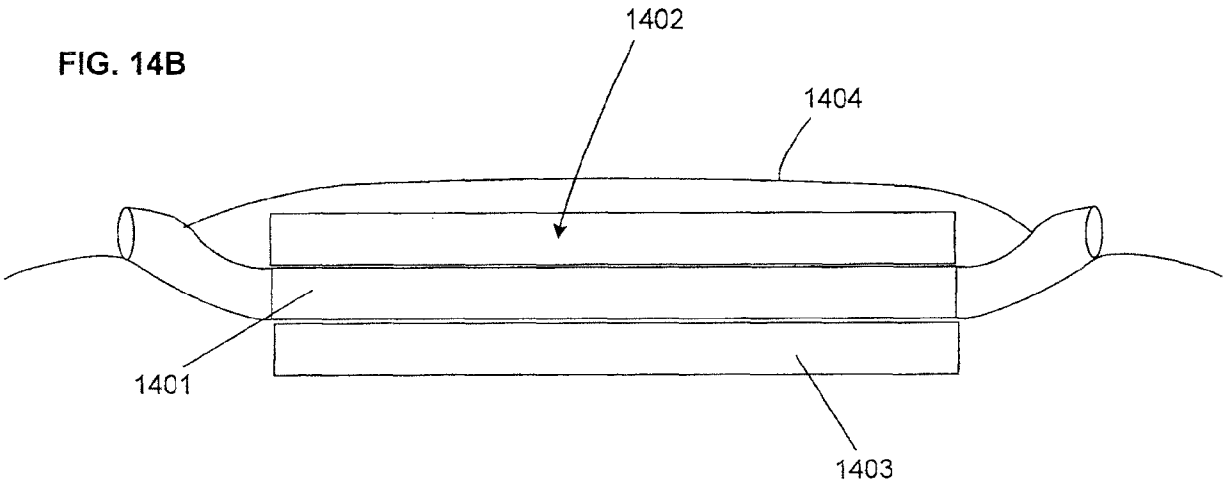

In another exemplary embodiment and with reference to FIG. 14B, radiating elements 1402 are substantially flush with the fuselage and cold plate 1401 is recessed into the fuselage. Additionally, cold plate 1401 is preferably located under radiating elements 1402.

Figure 15:
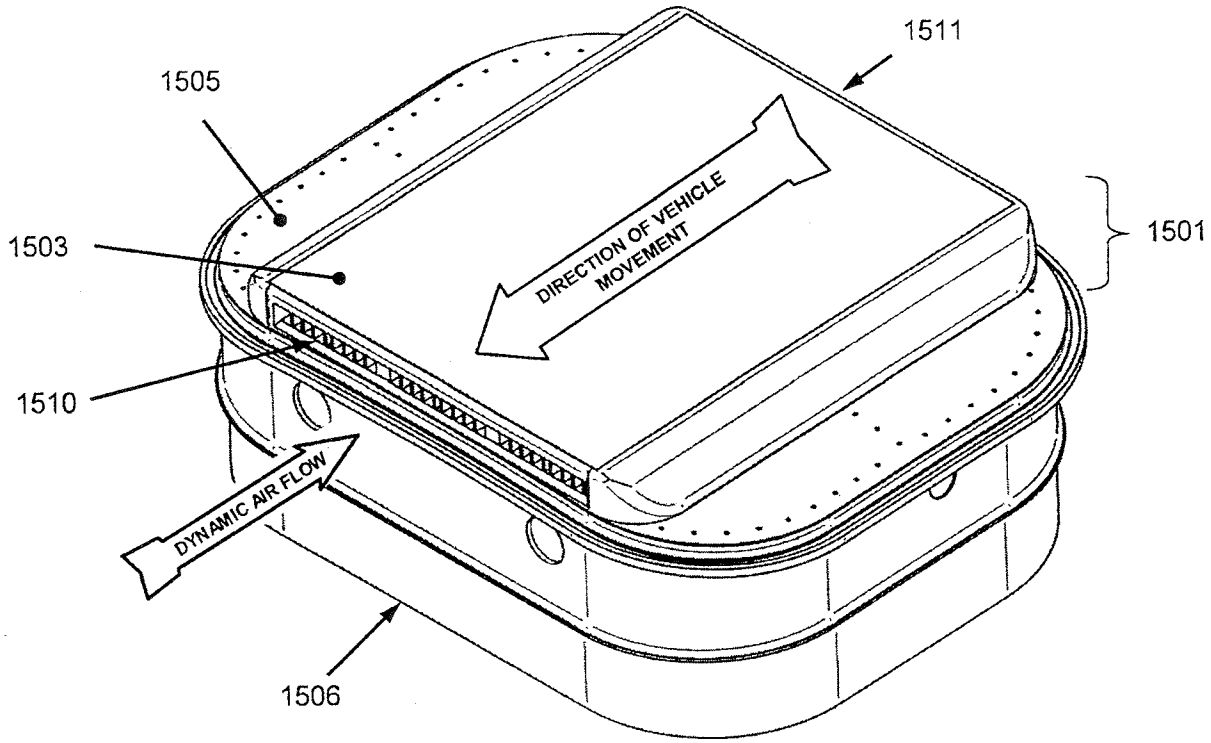
FIG. 15 illustrates an exemplary embodiment of a phased array antenna and cooling system connected to a hatch.

In accordance with an exemplary embodiment and with reference to FIG. 15, a phased array antenna 1501 and a cold plate 1502 are attached to an outer surface 1505 of a hatch 1506. Phased array antenna 1501 further comprises a radome 1503, and cold plate 1502 has a coolant air intake 1510 and a coolant air exit 1511. As an example, in an airplane embodiment, phased array antenna 1501 is mounted to outer hatch outer surface 1505 that is located on top of the fuselage near the cockpit. In another exemplary embodiment, phased array antenna 1501 is mounted to a door or hatch outer surface 1505 located on any part of the fuselage, including the sides.

The implementation of a passive cold plate provides various advantages over a typical dynamic cooling system for phased array antennas. For example, the passive cold plate is easily scalable to match the size of the antenna and/or aircraft. A pump system or other closed loop system would require design changes based on scaling. Another advantage is the lack of liquid cooling with the cold plate. Not using a liquid cooled system results in the elimination of an entire subsystem in the phased array antenna. This elimination provides for a more compact antenna system of equivalent capacity.

Yet another advantage is the level of cooling provided by a cold plate if the aircraft is in motion. A commercial airliner flies, on average, at a cruising altitude of 30,000-40,000 feet. The corresponding air temperature at these heights is −45° C. and −55° C., respectively. In an exemplary embodiment, the electrical circuits generally operate at a temperature difference of 70° C. above the surrounding temperature. For an aircraft traveling at the average cruising altitude, the electrical circuits would be operating at 25° C.-35° C. As a comparison, a typical liquid cooled systems runs at 40° C.-60° C., resulting in the electrical circuits operating at 110° C.-130° C. The effect is an operation temperature difference of 85° C.-105° C. between the cold plate system and the typical liquid cooled system. A lower operating temperature is important because various electrical circuits are more reliable and perform better at lower temperatures, as is known to one skilled in the art. Thus, in an exemplary embodiment, the electrical circuits are kept at 25° C.-35° C. during flight.

Figure 16A:
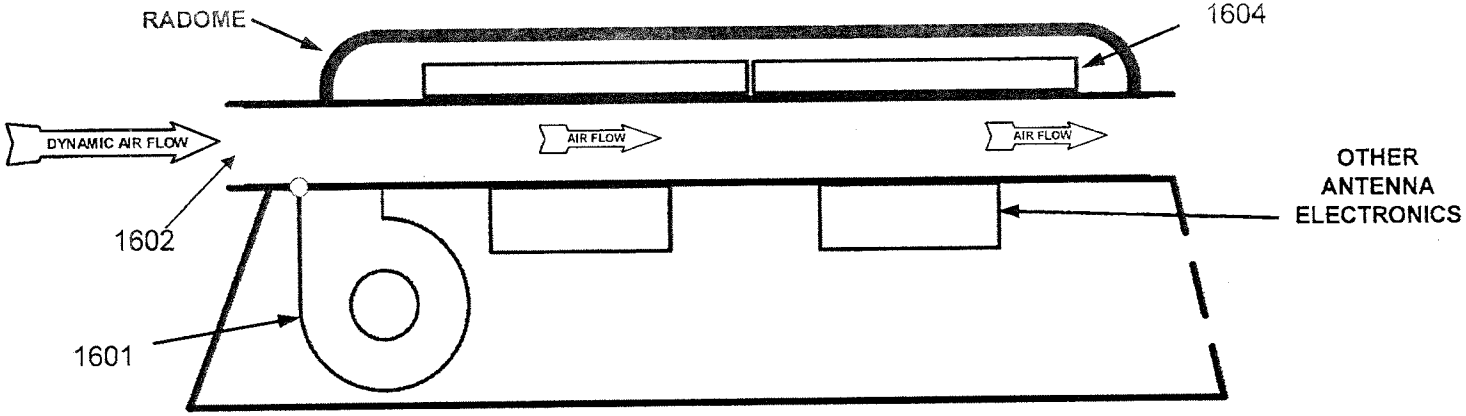
FIGS. 16A-16B illustrate an exemplary embodiment of a phased array antenna having a passive cooling system combined with an airflow blower.
Figure 16B:
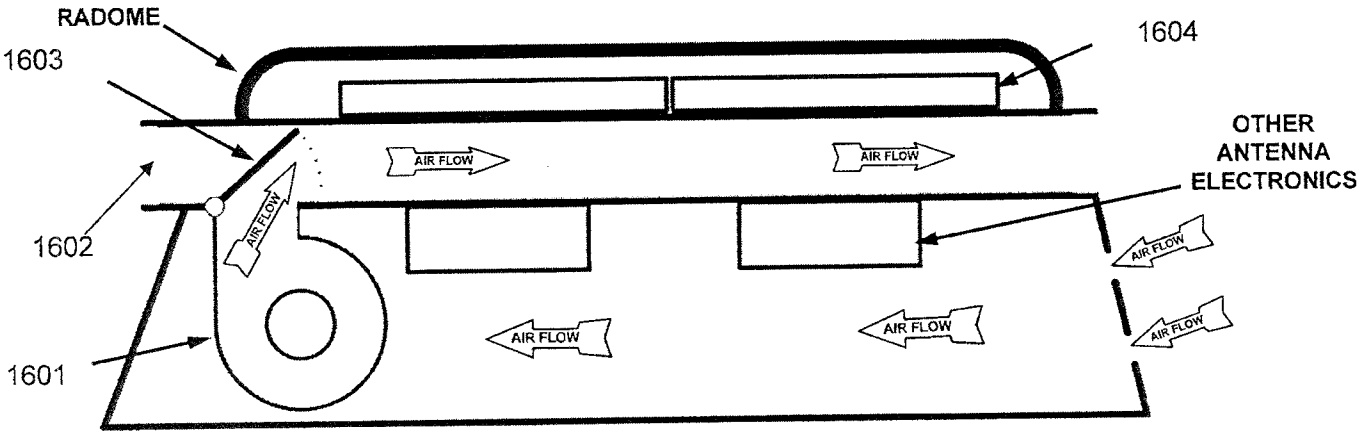

It is important to note that the cooling level supplied by the cold plate is dependent on the ambient air temperature and the pressure differential between the high dynamic air pressure in front of the antenna and the lower dynamic pressure aft of the antenna. The amount of cooling capability increases as the dynamic pressure increases and ambient temperature decreases. Furthermore, this passive cooling system provides little cooling if the aircraft is not moving. While the aircraft is on the ground, additional active cooling systems could be used the phased array antenna. For example, in an exemplary embodiment and with reference to FIGS. 16A and 16B, an airflow blower 1601 can be used in combination with a passive air cooling system. If dynamic air is flowing through an air flow passage 1602, a flapper 1603 covers the outlet of airflow blower 1601. If there is little or no dynamic airflow, airflow blower 1601 can be activated and force air to flow by antenna 1604. Furthermore, a similar system may be implemented using a liquid cooled pump system as previously described.

Figure 17:
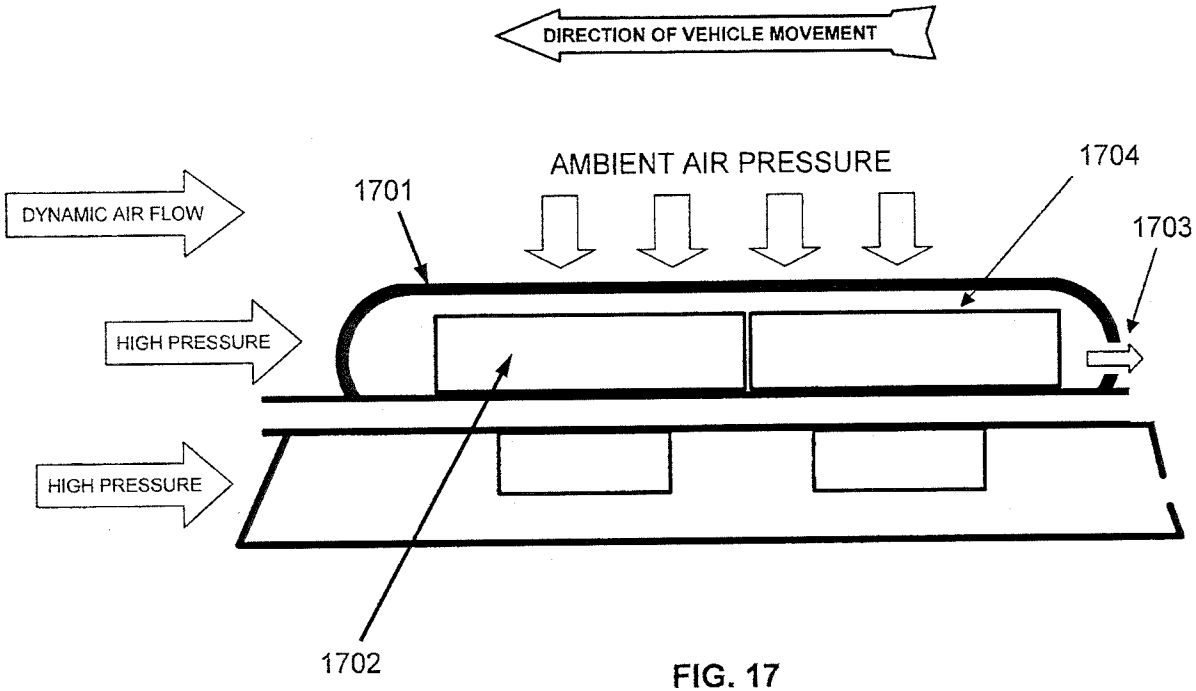
FIG. 17 illustrates an exemplary embodiment of a phased array antenna having a radome in intimate contact.

In one embodiment, the radome cover may induce a reduction in RF performance due to the use of electrically lossy materials that are typically used in radomes. In accordance with an exemplary embodiment and with reference to FIG. 17, a radome 1701 is designed to have a minimal effect on the antenna performance through the use of thinner materials and/or construction that exhibits lower loss than typical mobile radomes. In an exemplary embodiment, radome 1701 is forced into direct contact with an antenna structure 1702 by the creation of negative pressure inside radome 1701. The radome 1701 utilizes antenna structure 1702 for structural support rather than inherent structural strength. A vacuum is created by placing a vent 1703 at the rear of antenna structure 1702. In general, in rapidly moving vehicles, the pressure at the rear of antenna structure 1702 is one-half of the ambient pressure. In an exemplary embodiment, downward pressure on the top of radome 1701 is created. In one embodiment, radome 1701 can be in contact with radiating elements of antenna structure 1702. In a second embodiment, radome 1701 is separated from the radiating elements by a small air gap 1704.

In an exemplary embodiment, radome 1701 is held in intimate contact with antenna structure 1702 using a negative pressure, therefore radome 1701 can be not bonded to the radiating elements. This provides a benefit of permitting radome removal if needed for maintenance. Furthermore, in an exemplary embodiment, radome 1701 is constructed using a thin, flexible material. For example, the radome material may only be about 0.030 inches and may range in construction thickness for a single thin layer to a multilayer structure of 0.5 inches or more.

Principles of the present disclosure may also suitably be combined with principles for fragmented aperture antennas as disclosed in U.S. Provisional Ser. No. 61/265,587, filed on Dec. 1, 2009, and entitled "FRAGMENTED APERTURE FOR THE KA/K/KU FREQUENCY BANDS", the contents of which are hereby incorporated by reference in their entirety.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as critical, required, or essential features or elements of any or all the draft statements. As used herein, the terms "includes," "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Further, no element described herein is required for the practice of the invention unless expressly described as "essential" or "critical."

We claim:

1. An antenna system comprising:

an array of antenna elements;

element control electronics arranged on a surface of a circuit board, the element control electronics to adjust RF signals communicated with the array of antenna elements; and a passive cooling system to dissipate heat from the element control electronics, the passive cooling system comprising a cold plate contacting the surface of the circuit board and including an airflow channel to route dynamic airflow due to movement of the antenna system to dissipate the heat, the cold plate further including openings proximate to the surface of the circuit board, and wherein the element control electronics are within the openings.

2. The antenna system of claim 1, wherein the airflow channel routes the dynamic airflow from an air intake portion proximate a front of the cold plate to an air outlet proximate a back of the cold plate, and the air intake portion creates a pressure difference between the front and the back during the movement.

3. The antenna system of claim 1, further comprising an active cooling system for forcing airflow through the airflow channel to dissipate heat from the element control electronics while the antenna system is motionless.

4. The antenna system of claim 1, wherein the dynamic airflow is substantially in a single direction through the airflow channel.

5. The antenna system of claim 1, further comprising a radome overlying the array of antenna elements, the radome including a vent to create downward pressure on the radome during the movement of the antenna system.

6. The antenna system of claim 5, wherein the radome is not bonded to the array of antenna elements.

7. The antenna system of claim 5, wherein the radome is separated from the array of antenna elements by a gap.

8. The antenna system of claim 5, wherein the radome is in contact with the array of antenna elements due to the downward pressure.

9. The antenna system of claim 1, wherein the element control electronics are responsive to commands to scan a beam of the adjusted RF signals to a particular scan angle.

10. The antenna system of claim 1, wherein the passive cooling system is configured for mounting on a mobile platform.

11. The antenna system of claim 1, wherein the passive cooling system contains no active components.

12. The antenna system of claim 1, wherein the array of antenna elements are in a plurality of aperture tiles arranged in a plane.

13. The antenna system of claim 1, further comprising a plurality of aperture tiles, wherein each of the aperture tiles comprises a plurality of layers, and the circuit board is in one of the plurality of layers.

14. An antenna system comprising:

an array of antenna elements;

element control electronics arranged on a surface of a circuit board, the element control electronics to adjust RF signals communicated with the array of antenna elements; and a passive cooling system to dissipate heat from the element control electronics, the passive cooling system comprising a cold plate contacting the surface of the circuit board and located between the array of antenna elements and the element control electronics, the cold plate comprising:

a first airflow channel to route dynamic airflow due to movement of the antenna system to dissipate the heat;

a second airflow channel to dissipate the heat; and an interconnection port to communicate signals between the array of antenna elements and the element control electronics, the interconnection port positioned between the first airflow channel and the second airflow channel.

15. An antenna system comprising:

an array of antenna elements;

element control electronics arranged on a surface of a circuit board, the element control electronics to adjust RF signals communicated with the array of antenna elements;

a passive cooling system to dissipate heat from the element control electronics, the passive cooling system comprising a cold plate contacting the surface of the circuit board and including an airflow channel to route dynamic airflow due to movement of the antenna system to dissipate the heat; and a mounting surface for mounting to a moving platform, and wherein the airflow channel is at least partially located below the mounting surface.

16. The antenna system of claim 15, wherein the airflow channel routes the dynamic airflow from an air intake to an air outlet, and the air intake and the air outlet are located above the mounting surface.

17. An antenna system comprising:

an array of antenna elements;

element control electronics arranged on a surface of a circuit board, the element control electronics to adjust RF signals communicated with the array of antenna elements; and a passive cooling system to dissipate heat from the element control electronics, the passive cooling system comprising a cold plate contacting the surface of the circuit board and including an airflow channel to route dynamic airflow due to movement of the antenna system to dissipate the heat, wherein the airflow channel is between adjacent element control electronics, and wherein the airflow channel surrounds at least some of the element control electronics.

* * * * *